US007066135B2

(12) United States Patent
Ishikawa et al.

(10) Patent No.: US 7,066,135 B2
(45) Date of Patent: Jun. 27, 2006

(54) INTAKE SYSTEM FOR A VEHICLE ENGINE

(75) Inventors: Yuzuru Ishikawa, Saitama (JP); Yoshiteru Kinoshita, Saitama (JP); Takashi Kudo, Saitama (JP); Toshinori Hanai, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/876,746

(22) Filed: Jun. 25, 2004

(65) Prior Publication Data

US 2005/0045147 A1 Mar. 3, 2005

(30) Foreign Application Priority Data

Jul. 1, 2003 (JP) ..... 2003-189220
May 13, 2004 (JP) ..... 2004-144115

(51) Int. Cl.
*F02B 77/00* (2006.01)

(52) U.S. Cl. ..... 123/198 E; 123/579

(58) Field of Classification Search ..... 123/198 E, 123/579, 580, 581, 582, 583, 584
See application file for complete search history.

(56) References Cited

U.S. PATENT DOCUMENTS 6,422,201 B1 * 7/2002 Yamada et al. ..... 123/336
2004/0060545 A1 * 4/2004 Kurayoshi et al. ..... 123/472

FOREIGN PATENT DOCUMENTS

| | | |
|---|---|---|
| EP | 1081370 | 3/2001 |
| JP | 58155270 | 9/1983 |
| JP | 2000064919 | 3/2000 |
| JP | 2001073810 | 3/2001 |

* cited by examiner

*Primary Examiner*—John T. Kwon
(74) *Attorney, Agent, or Firm*—Carrier, Blackman & Associates, P.C.; William D. Blackman; Joseph P. Carrier

(57) ABSTRACT

An intake system for a vehicle engine includes an air cleaner and a plurality of throttle bodies. The air cleaner encases an air cleaner element in an air cleaner housing for filtering air flowing from an unfiltered air chamber to a filtered air chamber of the air cleaner housing. The throttle bodies control the amount of air supplied from the filtered air chamber to a cylinder head. Operating noise of the throttle bodies is minimized by situating the throttle bodies within the air cleaner housing. Operating noise of fuel injectors associated with the throttle bodies is minimized by situating the fuel injectors within the air cleaner housing.

21 Claims, 14 Drawing Sheets

INTAKE SYSTEM FOR A VEHICLE ENGINE

CROSS-REFERENCE TO RELATED APPLICATIONS

The present invention claims priority under 35 USC 119 based on Japanese patent application No. 2003-189220, filed Jul. 1, 2003, and on Japanese patent application No. 2004-144115, filed May 13, 2004.

BACKGROUND OF THE INVENTION

1. Field of the Invention

The present invention relates to an intake system for a vehicle engine, in which the intake system includes an air cleaner having a plurality of chambers formed therein, and a plurality of throttle bodies which are at least partly disposed within the air cleaner. The air cleaner encases at least one air cleaner element disposed within a housing that is divided by the air cleaner elements into an unfiltered air chamber and a filtered air chamber. The throttle bodies regulate the amount of air supplied from the filtered air chamber to engine cylinder heads.

2. Description of the Background Art

An intake system in which an air cleaner is connected through a throttle body to a cylinder head of an engine mounted on a motorcycle is known, for example, from Japanese Laid-open Patent No. 2001-73810. In this prior art system, the operating noise of the throttle bodies during throttle operation is great.

It is desirable to take steps to reduce the operating noise of the air intake system. Further, in vehicles where injectors are mounted on the throttle bodies, the injector operation adds to the operating noise of the system. Thus, it is desirable to reduce the operating noise of the injectors.

Although the known devices have some utility for their intended purposes, a need still exists in the art for an improved intake system for a motorcycle in which the noise created by the throttle bodies is reduced. In particular, a need exists for an intake system in which both throttle body noise and injector noise are significantly reduced.

SUMMARY OF THE INVENTION

The present invention has been accomplished in view of the foregoing problems with the known intake systems. It is an object of the invention to provide an intake system for a vehicle engine in which operating noise of the throttle bodies can be reduced or eliminated by a simple construction.

To achieve the above object, a first aspect of the present invention provides an improved air intake system, including an air cleaner, for a vehicle engine. The air cleaner includes an air cleaner housing that is divided into an unfiltered air chamber and a filtered air chamber. The air cleaner includes an air cleaner element, housed within the air cleaner housing, for filtering air flowing therethrough as it passes from the unfiltered air chamber to the filtered air chamber. Throttle bodies, for regulating an air amount supplied from the filtered air chamber to a cylinder head, are also housed in the air cleaner housing.

According to another aspect of the inventive air intake system, in addition to the structure of the invention described above, the unfiltered air chamber is formed so as to cause a portion of it to function as a suction chamber.

According to another aspect of the invention, in addition to the structure of the invention described above, the throttle bodies are disposed in the unfiltered air chamber.

According to another aspect of the invention, in addition to the structure of the invention described above, throttle cables extending from the throttle bodies are drawn outside of the air cleaner housing by extending through an opening formed in a portion of the wall of the unfiltered air chamber of the air cleaner housing.

According to another aspect of the invention, in addition to the structure of the invention described above, a cable grommet is mounted in the opening of the wall of the unfiltered air chamber of the air cleaner housing, and the throttle cables are inserted through the cable grommet.

According to another aspect of the invention, in addition to the structure of the invention described above, an embodiment of the invention is disclosed wherein the fuel injectors are housed in the unfiltered air chambers. In this aspect, a fuel pipe, for supplying fuel to the injectors, and a conductor connected to the injectors pass through an opening in the wall of the air cleaner housing. An harness grommet is mounted in the opening in the wall of the air cleaner housing, and the fuel pipe and conductor are inserted through this harness grommet.

According to another aspect of this invention, in addition to the structure of the invention described above, the air cleaner housing includes a first housing section, a second housing section, and a third housing section. The housing sections are connected to each other such that the second housing section is put between the first and third housing sections. The first housing section is supported by the intake subassemblies that guide filtered air, from the air cleaner, through the throttle bodies and to the cylinder head. The air cleaner element can be inserted into the first and second housing sections when the first and second housing sections are mutually connected but the third member is removed. An embodiment is disclosed wherein the air cleaner element is supported in the air cleaner housing by coupling of the third housing section, covering the air cleaner element, to the second housing section.

According to another aspect of this invention, in addition to the structure of the invention described above, an embodiment of the invention is disclosed wherein a cover portion of the air cleaner housing includes a bottom plate of a fuel tank.

According to another aspect of the invention, in addition to the structure of the invention described above, an embodiment of the invention is disclosed wherein the air cleaner element is arranged on the unfiltered air chamber.

According to another aspect of the invention, in addition to the structure of the invention described above, due to the simple configuration in which the throttle bodies are disposed in the air cleaner housing, the operating noise of the throttle bodies is substantially prevented from leaking outside the cleaning case. As a result, the operating noise of the throttle bodies can be reduced or eliminated. Further, by situating the throttle bodies within the air cleaner housing of the air cleaner, it becomes possible to prevent rainwater or the like from dropping on the throttle bodies. Furthermore, where the injectors are mounted on the throttle bodies housed within the air cleaner housing, the operating noise of the injectors can be reduced or eliminated, because the injectors are also disposed in the air cleaner housing.

Because the unfiltered air chamber is formed having a portion which functions as a suction chamber, employment of exclusive-use parts for forming the suction chamber is unnecessary. As a result, the number of parts needed is reduced, and the expense of forming the intake system is reduced. Further, since the part of the air cleaner housing can be used as a suction chamber, the whole intake system can be made more compact.

Because the throttle bodies are disposed in the unfiltered air chamber, it is possible to avoid lowering of the air filtered performance caused by the pressure drop across the air cleaner element.

Because the throttle cables extending from the throttle bodies extend through an opening in the unfiltered air chamber of the air cleaner housing, it is possible to simplify the airtight holding construction of the air cleaner housing.

Because a cable grommet is mounted within the opening in the unfiltered air chamber, and the throttle cables pass through the cable grommet as they exit the air cleaner housing, the sealability between the unfiltered air chamber and the outside is easily secured.

Because fuel injectors associated with the throttle bodies are also disposed within the air cleaner housing, the injectors are covered and protected by the air cleaner housing, and the operating noise of the injectors can be substantially prevented from leaking outside the air cleaner housing, to thereby reduce or eliminate the operating noise of the injectors. Moreover, because the lines associated with the fuel pipe and the conductors are drawn out of the air cleaner housing by passing through a harness grommet, the sealability between the unfiltered air chamber and the outside is easily secured.

Despite the construction in which components including the throttle bodies are disposed in the air cleaner housing, assembly of the air cleaner can be carried out easily.

Because some embodiments of the invention use the bottom plate of the fuel tank to provide the cover of the air cleaner housing, the number of parts used to form the air cleaner housing can be reduced.

Because the air cleaner element is arranged on the unfiltered air chamber, air introduced into the unfiltered air chamber flows upward to the air cleaner element side above the unfiltered air chamber, and dust or the like tends to be retained within in the unfiltered air chamber. The air cleaner element is hard to be contaminated, and the durability is enhanced.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

A number of selected illustrative embodiments of the present invention will be described hereinafter on the basis of the embodiments shown in the accompanying drawings. Herein, only structures considered necessary for clarifying the present invention are described. Other conventional structures, and those of ancillary and auxiliary components of the system, are assumed to be known and understood by those skilled in the art.

Figure 1:
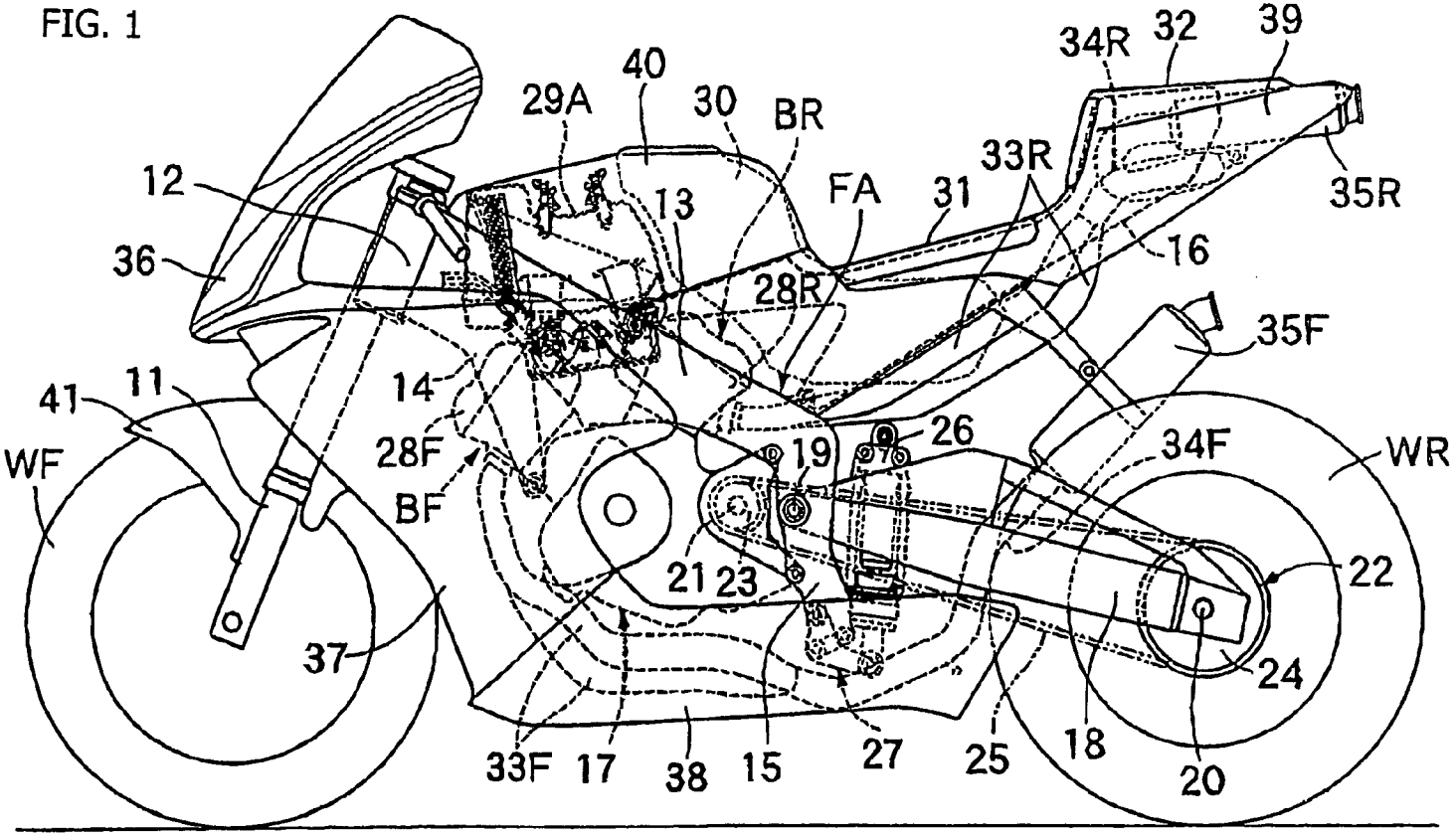
FIG. 1 is a side elevational view of a motorcycle including an intake system according to a first embodiment of the present invention.
Figure 2:
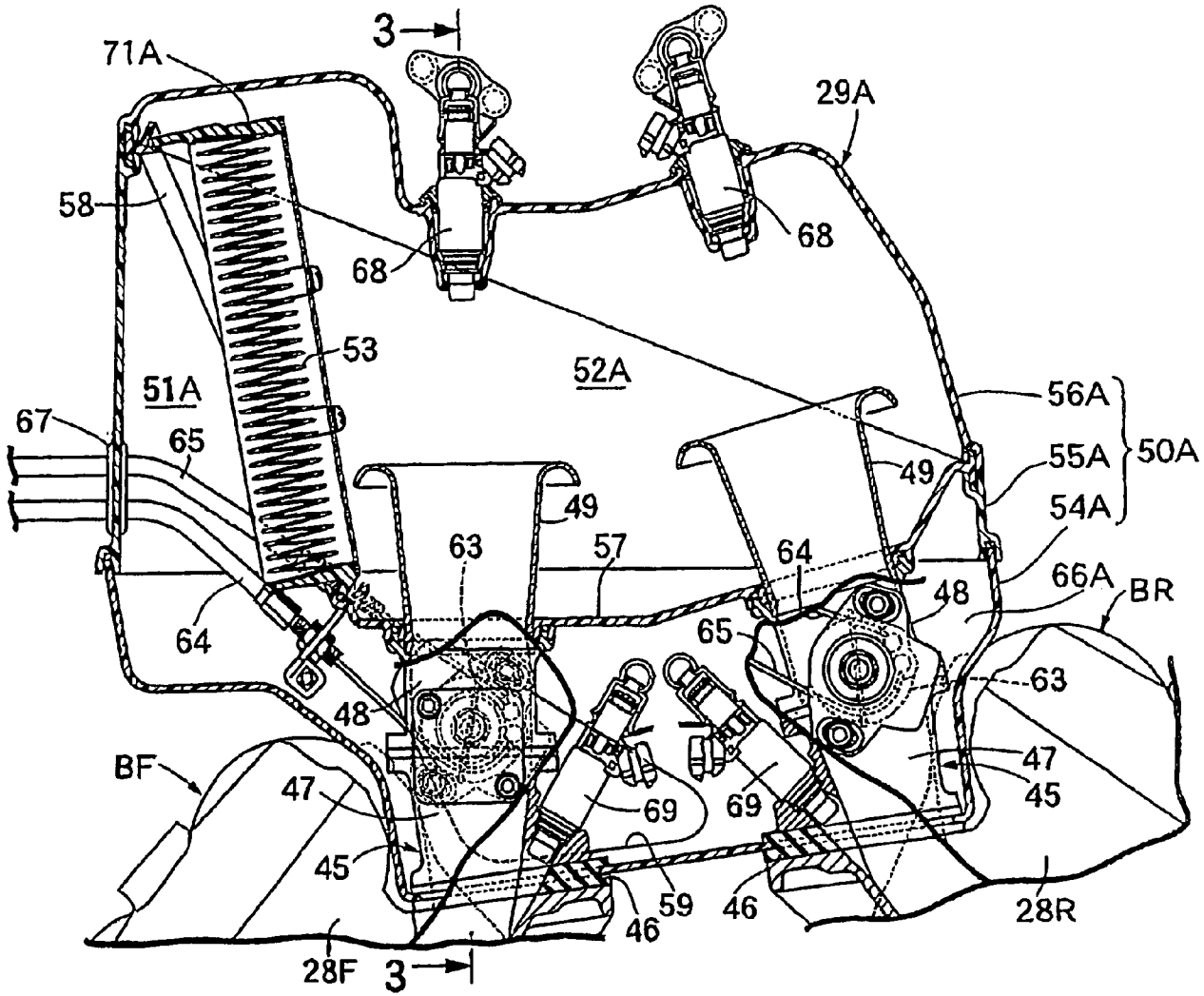
FIG. 2 is an enlarged cross-sectional detail view of an air cleaner according to the first embodiment of the present invention, which is mounted on the motorcycle of FIG. 1.
Figure 3:
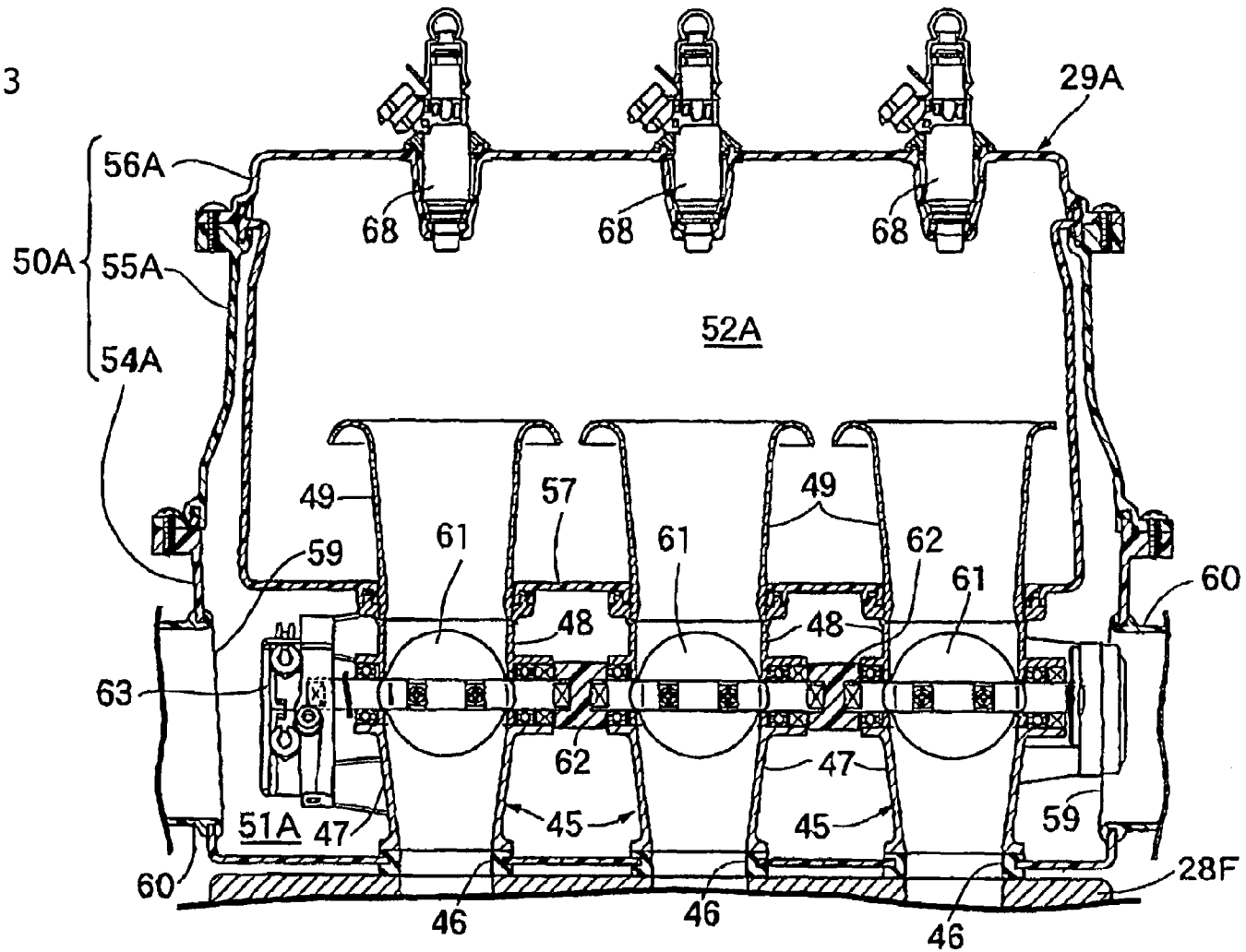
FIG. 3 is a cross-sectional detail view of the air cleaner of FIG. 2, taken on line 3—3 thereof.

FIGS. 1 to 3 show a first embodiment of an intake system for a motorcycle according to the the present invention. In FIG. 1, a body frame FA of the motorcycle includes a head pipe 12, a pair of left and right main frames 13, a pair of left and right engine hangers 14, a pair of left and right pivot plates 15, and a rear frame 16. The head pipe 12 pivotally supports a front fork 11 supporting a front wheel WF, in a manner capable of being steered by a driver. The pair of left and right main frames 13 extend backward and downward from the head pipe 12. The pair of left and right engine hangers 14 extend downward from the main frames 13, and are welded to the front portions of the head pipe 12 and also to both the main frames 13. The pair of left and right pivot plates 15 extend downward from the rear portions of the main frames 13. The rear frame 16 extends backward and upward and is connected to the rear portions of the main frames 13.

A multi-cylinder engine body 17 is supported on the lower portions of both the engine hangers 14, the intermediate portions of the main frames 13, and the upper portions and lower portions of the pivot plates 15. The engine body 17 is in the general shape of the letter V, and includes a front bank BF and a rear bank BR. In this embodiment, engine body 17 is described as having five cylinders, but the inventive concept is not limited to engines having 5 cylinders.

The front end of a swing arm 18 is pivotally supported on the vertical intermediate portions of both pivot plates 15, in a manner capable of swinging relative to a support shaft 19. The axle 20 of a rear wheel WR is rotatably supported on the rear end of the swing arm 18.

Power from an output shaft 21 of a speed change gear housed in the engine body 17 is transmitted to the rear wheel WR through a chain transmission mechanism 22. The chain transmission mechanism 22 includes a driving sprocket 23 secured to the output shaft 21, a driven sprocket 24 secured to the rear wheel WR, and an endless chain 25 stretched over the sprockets 23 and 24.

The upper end of a rear shock absorber 26 is connected to the front portion of the swing arm 18, and the lower end of the rear shock absorber 26 is connected to the lower portions of both the pivot plates 15 through a link mechanism 27.

An air cleaner 29A is arranged above cylinder heads 28F, 28R in the front and rear banks BF, BR of the engine body 17. A fuel tank 30 overlies the engine body 17 in back of the air cleaner 29A, and the fuel tank is supported on the rear frame 16. A main seat 31 is provided to support a rider thereon, and is supported on the rear frame 16 behind the fuel tank 30. A pillion seat 32 is supported on the rear frame 16 at a position away backward from the main seat 31.

First individual exhaust pipes 33F are associated with every cylinder on the cylinder head 28F of the front bank BF, and extend toward the rear wheel WR downward of the engine body 17. The first individual exhaust pipes 33F are connected in common to a first manifold 34F. Further, a first exhaust muffler 35F arranged on the upper right side of the rear wheel WR is supported on the rear frame 16, and the downstream end of the first manifold 34F is connected to the first exhaust muffler 35F. Second individual exhaust pipes 33R are associated with every cylinder on the cylinder head 28R of the rear bank BR. Second individual exhaust pipes 33R extend backward passing above the rear shock absorber 26, and are connected in common to a second manifold 34R. Further, a second exhaust muffler 35R supported on the rear frame 16 is arranged below the pillion seat 32, and the downstream end of the second manifold 34R is connected to the second exhaust muffler 35R.

The front of the head pipe 12 is covered with a front cowl 36, and both front sides of the body are covered with a center cowl 37 continuous to the front cowl 36. Lower cowls 38 cover the first individual exhaust pipes 33F and are aligned with the center cowl 37. Cowls 36, 37, and 38 are preferably formed of synthetic plastic. Further, the rear portion of the rear frame 16 is covered with a rear cowl 39, together with the major portion of the second exhaust muffler 35R. The fuel tank 30 and the air cleaner 29A are covered with a cover 40, and a front fender 41 is provided above the front wheel WF and is mounted on a front fork 11.

As shown in FIG. 2 and FIG. 3, an individual intake subassembly 45 is connected to each respective cylinder at the upper side walls of the cylinder heads 28F, 28R, in both banks BF, BR of the engine body 17. The intake subassemblies 45 are provided extending linearly so as to guide filtered air from the air cleaner 29A therethrough, and into the respective individual cylinders of the engine via the cylinder heads 28F, 28R.

Each respective intake subassembly 45 includes an insulator 46, an air duct pipe 47, a throttle body 48, and an air intake funnel 49. The insulator 46 is connected to one of the respective upper side walls of the cylinder heads 28F, 28R. The downstream end of the air duct pipe 47 is connected to the insulator 46. The upstream end of the air duct pipe 47 is connected to the throttle body 48. The base of the air intake funnel 49 is connected to the upstream end of the throttle body 48. At least parts of the throttle bodies 48, the air intake funnels 49, and the air duct pipes 47 are disposed in an air cleaner housing 50A of the air cleaner 29A. In the depicted embodiment of FIGS. 2–3, these components 47, 48, 49 are entirely situated inside of the air cleaner housing 50A.

The interior of the air cleaner 29A supportively encases an air cleaner element 53 that filters air flowing from an unfiltered air chamber 51A to a filtered air chamber 52A defined on opposite sides of the element 53 within the air cleaner housing 50A. The throttle bodies 48 are disposed in the unfiltered air chamber 51A of the air cleaner housing 50A, and the air intake funnels 49 are disposed in the filtered air chamber 52A of the air cleaner housing 50A.

The air cleaner housing 50A includes first, second, and third housing sections 54A, 55A, and 56A. The housing sections 54A, 55A, and 56A are mutually connected so as to put the second housing section 55A between the first and third housing sections 54A and 56A. The first and third housing sections 54A, 56A are each formed in the shape of a bowl having mutually opposed sides and an open end. The second housing section 55A is formed in the shape of a tube, and joins the respective open ends of the first and third housing sections 54A, 56A.

The whole peripheral edge of a partition plate 57, formed of synthetic plastic, is held in an airtight manner between the connected ends of the second and third housing sections 55A, 56A. The interior of the air cleaner housing 50A is divided into an unfiltered air chamber 51A and a filtered air chamber 52A by the partition plate 57. Moreover, a support frame 71A of the air cleaner element 53 is mounted on the partition plate 57 facing toward an opening 58. Opening 58 is provided in the partition plate 57 at a position above the front bank BF. Accordingly, when the first and second housing sections 54A, 55A are mutually connected but the third housing section 56A is removed, the air cleaner element 53 can be inserted into the first and second housing sections 54A, 55A. The third housing section 56A is connected to the second housing section 55A so as to cover the air cleaner element 53 and the partition plate 57. Thus, the air cleaner element 53 is supported on the air cleaner housing 50A above the unfiltered air chamber 51A.

The first housing section 54A is supported on the intake subassemblies 45. In the first embodiment, the ring-like insulators 46 are interposed between the air duct pipes 47 of the intake subassemblies 45 and the cylinder heads 28F, 28F. The air duct pipes 47 are fastened to the cylinder heads 28F, 28R so that the ring-like insulators 46 reside between the air duct pipes 47 and the cylinder heads 28F, 28R. As a result, the first housing section 54A is supported by insulators 46 found within each of the plurality of intake subassemblies 45. Thus, the throttle bodies 48 are disposed in the unfiltered air chamber 51A of the air cleaner 29A, since they are held between the partition plate 57 and the air duct pipes 47. The air intake funnels 49 are connected to the throttle bodies 48 and are projected into the filtered air chamber 52A from the partition plate 57.

Further, air-introducing holes 59 are provided in both sides of the first housing section 54A so as to communicate with the unfiltered air chamber 51A. Snorkels 60 are connected to both sides of the first housing section 54A, respectively, are connected to both sides of the first housing section 54A for taking in air from the outside and directing it into the unfiltered air chamber 51A through the air-introducing holes 59.

Moreover, the air-introducing holes 59 are provided on both sides of the first housing section 54A on the side corresponding to the intake subassemblies 45 on the front bank BF side. The unfiltered air chamber 51A is formed having generally a two-chamber construction corresponding to the front bank BF and the rear bank BR. The portion of the first housing section 54A on the side away from the air cleaner element 53 with respect to the air-introducing holes 59, that is, the portion on the side corresponding to the rear bank BR, within the unfiltered air chamber 51A, is to function as the suction chamber 66A. The suction chamber 66A on the rear bank BR side functions as a resonator. Thereby, the suction noise can be reduced, and the engine output characteristics can be made adequate.

The throttle bodies 48 are provided with throttle valves 61 for controlling the amount of air guided through the air intake funnels 49 from the filtered air chamber 52A of the air cleaner 29A. Throttle valves 61 of the throttle bodies 48 are disposed in a series of three corresponding to the front bank BF. Throttle valves 61 of the throttle bodies 48 are disposed in a series of two corresponding to the rear bank BR. Throttle valves within a series are mutually connected by interlock/connection structure 62. Throttle drums 63, aligned with and mutually interlocked/connected with throttle valves 61, are arranged on the outer surfaces of the throttle bodies 48 so as to reside on one end side in alignment with direction in which the throttle bodies 48 are arranged.

One end of a pair of throttle cables 64, 65 for opening and closing the throttle valves 61 are mutually stretched over and engaged, reversibly, with the throttle drums 63 corresponding to the front bank BF and the rear bank BR. The throttle cables 64, 65 extend through unfiltered air chamber 51A and exit out of the air cleaner housing 50A by passing through second housing section 55A in the first embodiment, and are drawn outside. Moreover, cable grommets 67 are mounted within the second housing section 55A of the air cleaner housing 50A, such that the paired two sets of throttle cables 64, 65 pass through the cable grommets 67 as they exit the air cleaner housing 50A.

Upper injectors 68 are mounted to the third housing section 56A above every cylinder, such that they reside at the cover of the air cleaner housing 50A so as to be arranged above the filtered air chamber 52A. The upper injectors 68 inject fuel when the engine rotates at high speed. The funnels 49, corresponding to the cylinders, are arranged within the filtered air chamber 52A in alignment with the upper injectors 68.

Further, fluids received within funnels 49 pass through the throttle bodies 48, the air duct pipes 47, and the cylinder head 28F, and since these components are arranged so as to extend below filtered air chamber 52A and out of the unfiltered air chamber 51A, such fluids pass therethrough.

Lower injectors 69 are mounted on the air duct pipes 47 of every cylinder, and the lower injectors inject fuel at regular timed intervals during operation of the engine. The lower injectors 69 are also disposed in the unfiltered air chamber 51A of the air cleaner housing 50A.

Conductors continuous to the lower injectors 69, as well as conductors continuous to position sensors mounted on the throttle bodies 48, which have a configuration that is similar to the throttle cables 64, 65, are drawn outside of air cleaner housing 50A by extending through the second housing section 55A. Harness grommets (not shown) may be provided surrounding these conductors in the areas where they pass outwardly from the air cleaner housing 50A.

Next, the operation of the first embodiment will be described. Since the throttle bodies 48 are disposed in the air cleaner housing 50A of the air cleaner 29A, the operating noise of the throttle bodies 48 is muted from leaking outside the air cleaner housing 50A. Thus, the operating noise of the throttle bodies 48 is reduced or eliminated by simply situating the throttle bodies 48 within the air cleaner housing 50A. Moreover, by situating the throttle bodies 48 within the air cleaner housing 50A, it is possible to protect the throttle bodies 48 from rainwater or the like.

Further, the unfiltered air chamber 51A is formed and configured to provide a part thereof that functions as the suction chamber 66A. Using exclusive-use parts to form the suction chamber 66A is therefore rendered unnecessary, and thus, the number of parts used can be reduced to lower the cost of fabrication.

Since the lower injectors 69 are also disposed in the unfiltered air chamber 51A, the lower injectors 69 are covered and protected by the air cleaner housing 50A. Most of the operating noise of the lower injectors 69 is retained within the air cleaner housing 50A, thereby reducing or eliminating the noise of the lower injectors 69.

Further, since the air cleaner element 53 is arranged above the unfiltered air chamber 51A, air introduced into the unfiltered air chamber 51A flows upward to the inlet side of the air cleaner element 53 above the unfiltered air chamber 51A. Dust or the like tends to be retained in the unfiltered air chamber 51A, whereby the air cleaner element 53 effectively resists becoming contaminated, and the durability of the engine is enhanced.

Further, since the throttle bodies 48 are disposed in the in the unfiltered air chamber 51A, throttle cables 64, 65 must pass through the wall of air cleaner housing 50A. To prevent any resultant lowering of the air filtered performance, and to simplify the airtight holding construction of the part in which the throttle cables 64, 65 extend through the air cleaner housing 50A, throttle cables 64, 65 are passed through the cable grommet 67. Cable grommet 67 is mounted on the second housing section 55A of the air cleaner housing 50A at the portion facing toward the unfiltered air chamber 51A, and the throttle cables 64, 65 are inserted into the cable grommet 67. Therefore, the throttle cables 64, 65 can extend through the wall of the air cleaner housing 50A while easily maintaining the seal between the unfiltered air chamber 51A and the outside.

Moreover, the air cleaner housing 50A is configured having the first, second, and third housing sections 54A, 55A, and 56A. Housing sections 54A, 55A, and 56A are mutually connected so as to put the second housing section 55A between the first and third housing sections 54A and 56A. The first housing section 54A is supported on the intake subassembly 45 constituted to include the throttle body 48 in order to introduce filtered air from the air cleaner 29A and connected to the cylinder heads 28F, 28R. The air cleaner element 53 can be inserted into the first and second housing sections 54A, 55A when the first and second housing sections 54A, 55A are mutually connected but the third housing section 56A is removed. The air cleaner element 53 is supported on the air cleaner housing 50A according to coupling of the third housing section 56A covering the air cleaner element 53 to the second housing section 55A. Accordingly, despite the construction in which components including the throttle body 48 are disposed in the air cleaner housing 50A, assembling of the air cleaner 50A can be carried out readily.

Furthermore, since components including the throttle body 48 are disposed in the air cleaner housing 50A, the capacity of the air cleaner housing 50A can be sufficiently secured.

Figure 4:
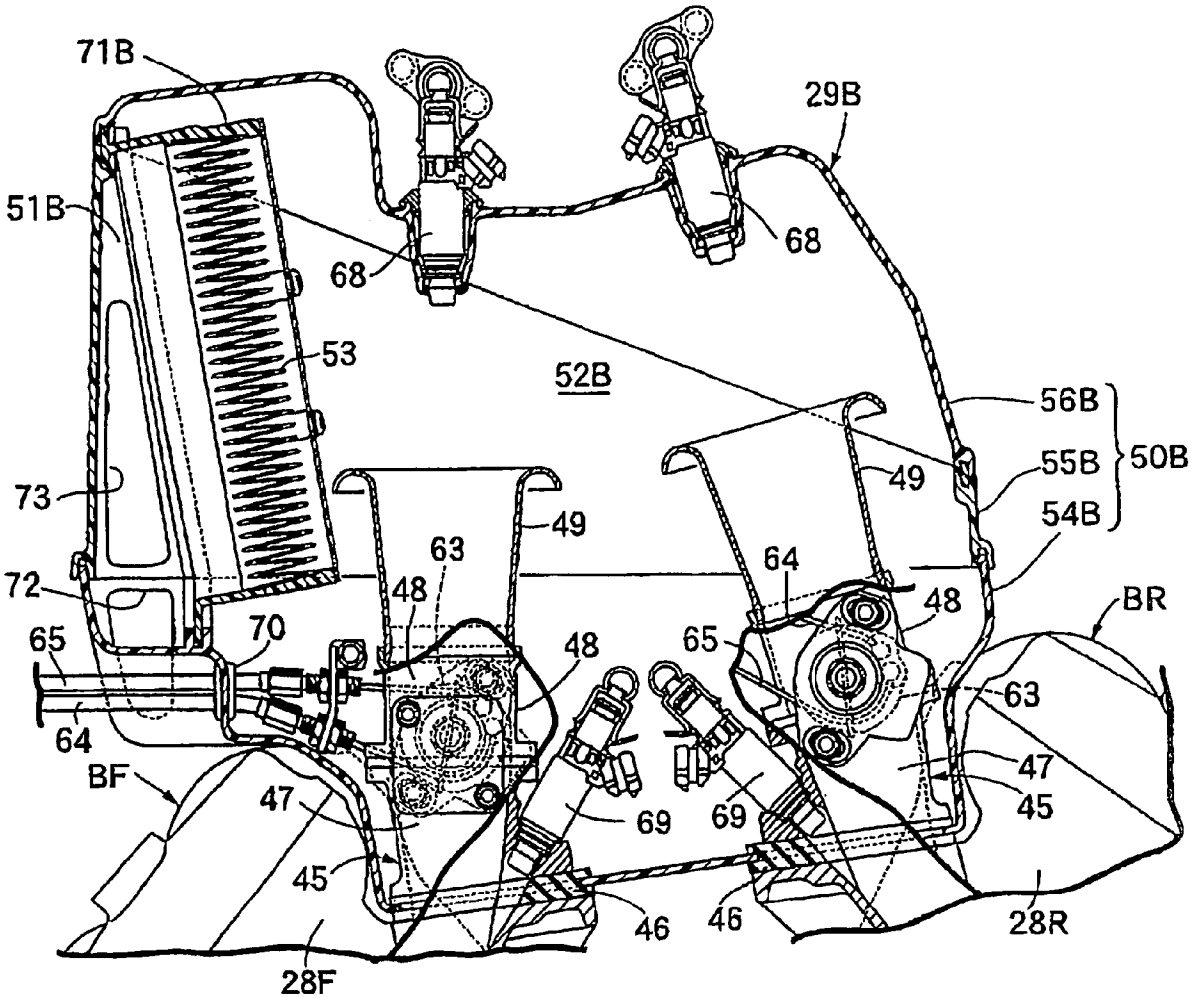
FIG. 4 is a cross-sectional detail view of an air cleaner according to a second embodiment hereof.

FIG. 4 shows an intake system according to a second embodiment of the present invention. Parts corresponding to those of the first embodiment are indicated by the same reference numerals.

In the embodiment of FIG. 4, an air cleaner 29B including a housing 50B is shown, containing an air cleaner element 53 and a plurality of intake subassemblies 45. An individual intake subassembly 45 is operatively connected to each respective cylinder, at upper side walls of cylinder heads 28F, 28R in both banks BF, BR of the engine body 17. The respective intake subassemblies 45 extend linearly so as to guide filtered air from an air cleaner 29B above the cylinder heads 28F, 28R.

As noted, in this embodiment, the air cleaner 29B includes an air cleaner element 53 housed within an air cleaner housing 50B. The interior of air cleaner housing 50B is divided into an unfiltered air chamber 51B and a filtered air chamber 52B. The air cleaner element 53 is disposed in the unfiltered air chamber 51B, and provides for filtering air flowing therethrough from the unfiltered air chamber 51B to the filtered air chamber 52B. The throttle body 48 and air intake funnel 49 of each of the intake subassemblies 45 are disposed in the filtered air chamber 52B of the air cleaner housing 50B.

The air cleaner housing 50B includes first, second, and third housing sections 54B, 55B, and 56B that are mutually connected, so as to put the second housing section 55B between the first and third housing sections 54B and 56B. The first and third housing sections 54B, 56B are each respectively formed in the shape of a bowl having mutually opposed sides and an open end. The second housing section 55B is formed in the shape of a tube, and joins the respective open ends of the first and third housing sections 54B, 56B. The first housing section 54B is supported on the insulators 46 of the intake subassemblies 45.

A support frame 71B for supporting the air cleaner element 53 is mounted between the first housing section 54B and the second and third housing sections 55B, 56B. The air cleaner housing 50B is internally defined into an unfiltered air chamber 51B and a filtered air chamber 52B by the air cleaner element 53 and the support frame 71B. Accordingly, the support frame 71B of the air cleaner element 53 can be inserted into the first and second housing sections 54B, 55B and mounted on the first housing section 54B side when the first and second housing sections 54B, 55B are mutually connected but the third housing section 56B is removed. During operation, the third housing section 56B is detachably connected to the second housing section 55B so as to cover the air cleaner element 53. Thus, the air cleaner housing 50B is configured, and the air cleaner element 53 is supported on the air cleaner housing 50B.

Air-introducing holes 72, 73 are provided so as to communicate with the unfiltered air chamber 51B on both sides of the first and second housing sections 54B, 55B, and air from outside is introduced into the unfiltered air chamber 51B through the air-introducing holes 72, 73.

Throttle cables 64, 65, corresponding to the front bank BF and the rear bank BR, respectively, and having respective first ends stretched and engaged with throttle drums 63, extend through filtered air chamber 52B and are drawn outside of air cleaner housing 50B by passing through an opening in the first housing section 54B. Moreover, the cable grommets 70 are mounted within this opening in the first housing section 54B of the air cleaner housing 50B, and the paired two sets of the throttle cables 64, 65 are inserted through the cable grommets 70.

According to the second embodiment, since the throttle bodies 48 are disposed in the air cleaner housing 50B of the air cleaner 29B, the operating noise of the throttle bodies 48 is substantially prevented from leaking outside the air cleaner housing 50B. Thus, the operating noise of the throttle bodies 48 is reduced or eliminated by situating the throttle bodies 48 in the air cleaner housing 50B.

Further, since the throttle bodies 48 are encase in the filtered air chamber 52B, the throttle bodies 48 operate in a clean environment. Thus, the operating part of the throttle bodies 48 are protected from damaging influences such as dust or the like.

Moreover, the first, second, and third housing sections 54B, 55B, and 56B of the air cleaner housing 50B are mutually connected so as to put the second housing section 55B between the first and third housing sections 54B, 56B. The air cleaner element 53 can be inserted into the first and second housing sections 54B, 55B when the first and second housing sections 54B, 55B are mutually connected but the third housing section 56A is removed. The air cleaner element 53 is supported within the air cleaner housing 50B when the third housing section 56B, which covers the air cleaner element 53, is connected to the second housing section 55B. Accordingly, despite the configuration in which components including the throttle body 48 are disposed in the air cleaner housing 50B, assembly of the air cleaner 50B can be carried out easily.

Further, the support frame 71B of the air cleaner element 53 is mounted and supported between the first housing section 54B and the second and third housing sections 55B, 56B. Exclusive-use parts for mounting the support frame 71B are therefore rendered unnecessary, and thus, the number of parts is reduced to simplify the support construction of the air cleaner element 53.

Further, since the components including the throttle body 48 are disposed in the air cleaner housing 50B, the capacity of the air cleaner housing 50B can be sufficiently secured.

Figure 5:
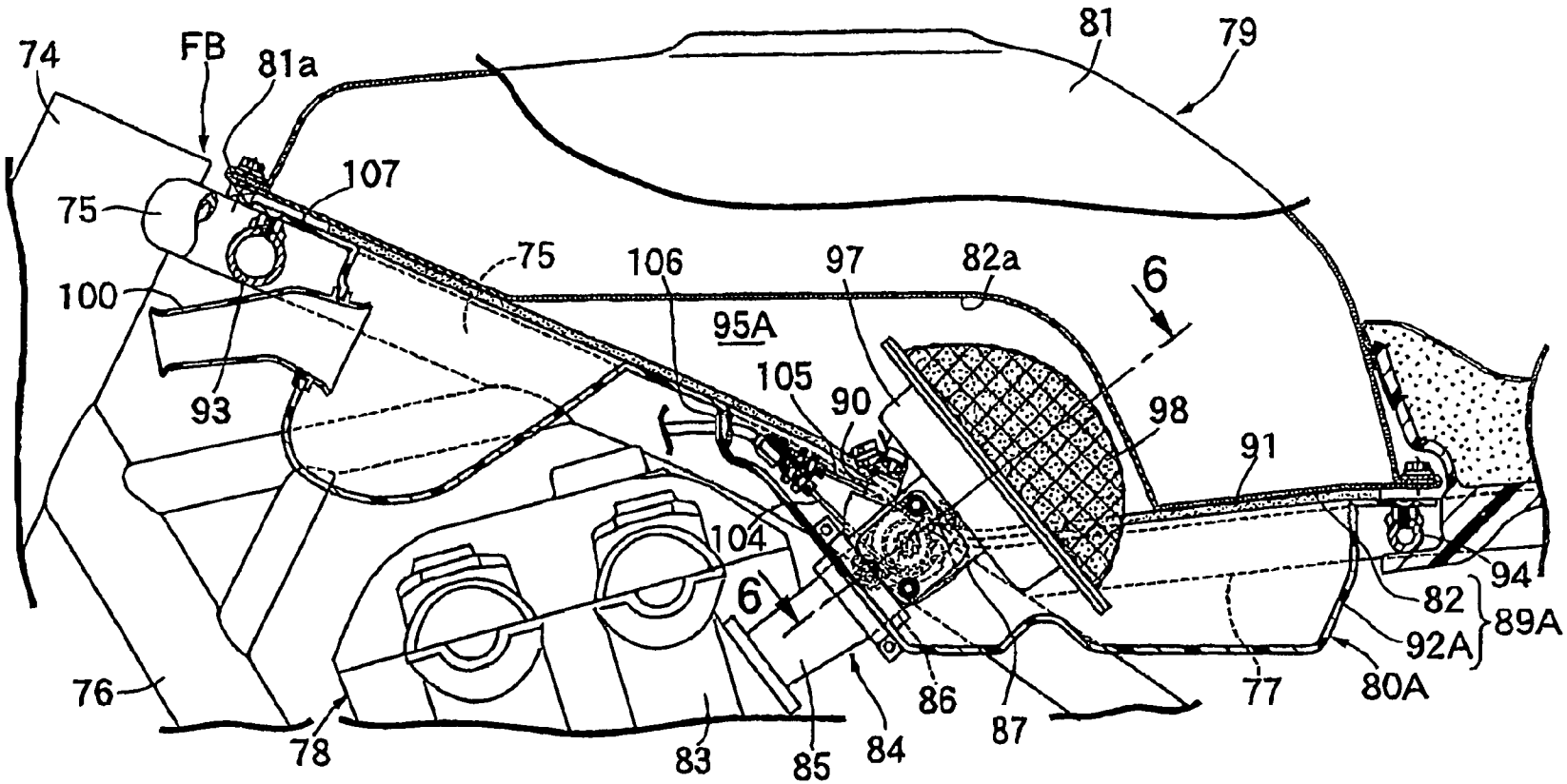
FIG. 5 is a longitudinal side view, partly in cross-section, of an air cleaner according to a third embodiment hereof.
Figure 6:
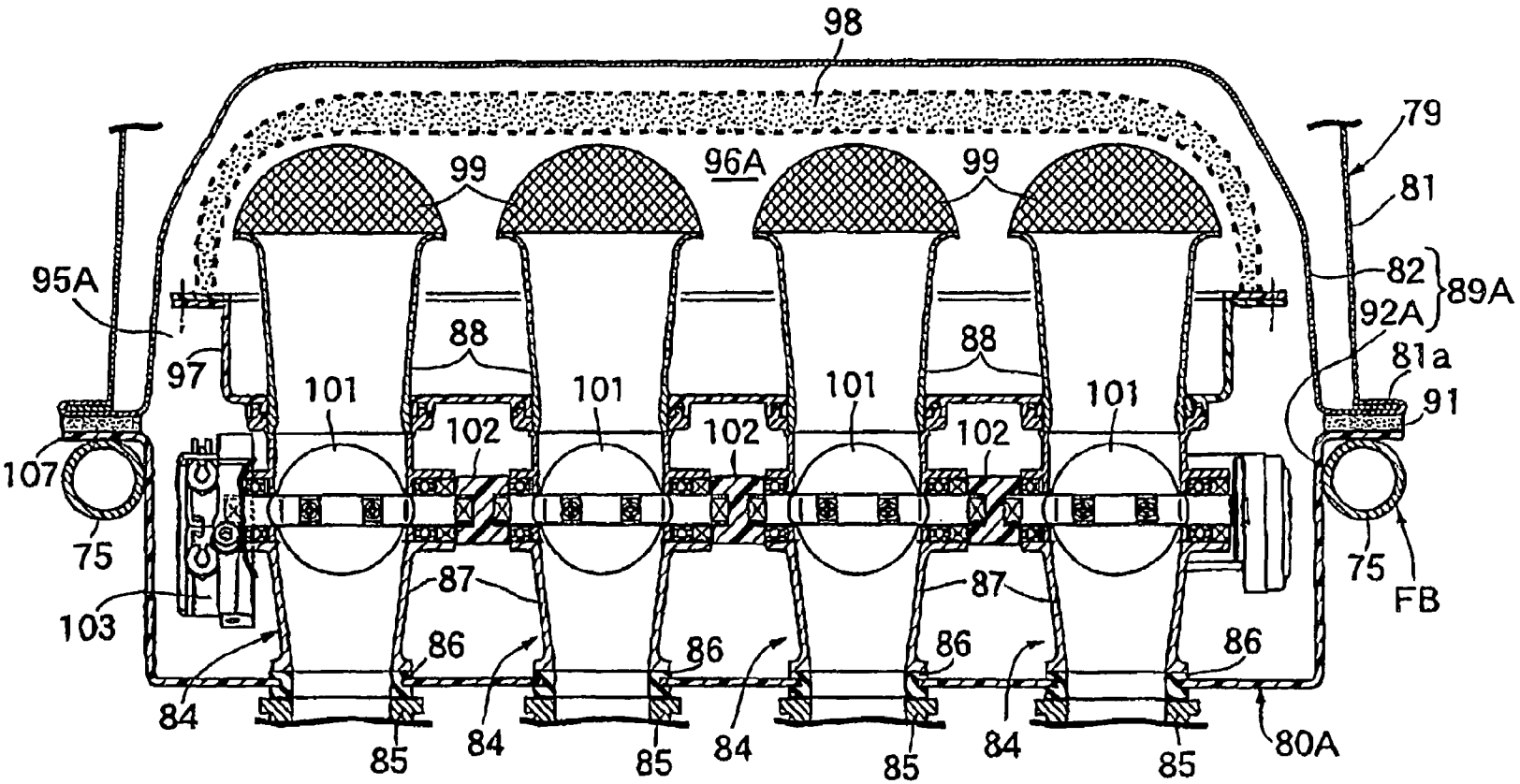
FIG. 6 is a cross-sectional view of the air cleaner of FIG. 5, taken on line 6—6 thereof.

FIG. 5 and FIG. 6 show an air intake system according to a third embodiment of the present invention. A body frame FB of the motorcycle includes a pair of left and right main frames 75, 75 extending backward and downward from a head pipe 74, a down tube 76 extending downward from the head pipe 74, and a pair of left and right seat rails 77 extending backward from the rear portions of both the main frames 75, 75. The series multi-cylinder engine body 78 is supported on the main frames 75, 75 and the down tube 76. In this embodiment, series multi-cylinder engine body 78 is described having a series four-cylinder engine, but the inventive concept is not limited to an engine having four cylinders.

A fuel tank 79 is arranged above both the main frames 75 and both the seat rails 77, and an air cleaner 80A is arranged between the engine body 78 and the fuel tank 79.

The fuel tank 79 includes a downwardly open bowl-like tank case 81 and a bottom plate 82, which is for blocking the lower open end of the tank case 81. The peripheral edge of the bottom plate 82 is caulked and connected to a flange 81 a provided on the peripheral edge at the lower open end of the tank case 81.

Intake subassemblies 84 extend linearly so as to guide filtered air from the air cleaner 80A and are connected to the respective cylinders at the upper side wall of the cylinder head 83 in the engine body 78.

Each of the respective intake subassembies 84 includes an air duct pipe 85 connected to the upper side wall of the cylinder head 83, an insulator 86 connected to the upstream end of the air duct pipe 85, a throttle body 87 having its downstream end connected to the insulator 86, and an air intake funnel 88 connected to the upstream end of the throttle body 87. The throttle body 87 and the air intake funnel 88 are disposed in an air cleaner housing 89A of the air cleaner 80A, and an injector 90 is mounted on the throttle body 87.

The air cleaner housing 89A includes part of the bottom plate 82 of the fuel tank 79, and a housing section 92A formed of synthetic plastic having an endless gasket 91. The gasket 91 is interposed between the outer peripheral portion of the bottom plate 82 and the housing section 92A. The gasket 91 is interposed between a flange 107 provided in the outer periphery of the housing section 92A and the outer peripheral portion of the bottom plate 82. That is, the air cleaner housing 89A is formed so that part of the bottom plate 82 of the fuel tank 79 is intended to function as a cover for the air cleaner housing. The fuel tank is formed with a recess 82*a* in the bottom thereof, recessed upwardly in the bottom plate 82, for increasing the capacity of the air cleaner housing 89A.

Moreover, lateral sides of air cleaner housing 89A are supported such that lateral portions of the flange 107 rests on both main frames 75 of the body frame FB. The front and rear portions of the air cleaner housing 89A are supported such that the respective front and rear portions of the flange 107 are fastened to cross members 93, 94 mounted between both main frames 75 and between both seat rails 77, respectively. The housing section 92A is supported on the intake subassemblies 84, and in the third embodiment, the housing section 92A is supported on the insulators 86 of the intake subassemblies 84.

The air cleaner housing 89A is internally divided into the unfiltered air chamber 95A and the filtered air chamber 96A. The filtered air chamber 96A is formed between a partition plate 97 and an air cleaner element 98. The partition plate 97 is supported on the upstream end of each air intake funnel 88 and formed to be bowl-like. The air cleaner element 98 is mounted on the partition plate 97 to cover the open end of the partition plate 97. The air intake funnels 88, which include back fire screens 99, are mounted on the upstream open end of throttle bodies 87, and are disposed in the filtered air chamber 96A. The throttle bodies 87 are disposed in the unfiltered air chamber 95A formed in the air cleaner housing 89A below the partition plate 97 and the air cleaner element 98.

A snorkel 100 is operatively connected to the unfiltered air chamber 95A, via the front portion of the housing section 92A, so as to communicate therewith. Further, throttle valves 101 of the throttle bodies 87 are mutually connected by interlock/connection structure 102. Throttle drums 103, placed in alignment with and mutually interlocked/connected with the throttle valves 101, are arranged on the outer side of the throttle body 87 on one end, and are in alignment with the series of throttle bodies 87. Throttle cables have a first end 104, 105, stretched and engaged with the throttle drums 103. The cables 104, 105 exit air cleaner housing 89A such that they extend through the housing section 92A. A grommet 106 is mounted in housing section 92 and receives the cables 104, 105 therethrough. The grommet 106 is mounted on within the unfiltered air chamber 95A of the air cleaner housing 89A.

According to the third embodiment, since the throttle bodies 87 and the injectors 90 are disposed in the air cleaner housing 89A of the air cleaner 80A, the operating noises of the throttle bodies 87 and the injectors 90 can be substantially prevented from leaking outside the air cleaner housing 89A. Thus, the operating noises of the throttle bodies 87 and the injectors 90 are reduced or eliminated, by situating the throttle bodies 87 and the injectors 90 in the air cleaner housing 89A.

Further, the throttle bodies 87 are disposed in the unfiltered air chamber 95A, and the throttle cables 104, 105 for opening and closing the throttle valves 101 of the throttle bodies 87 are drawn outside of the air cleaner housing 89A by passing through an opening in the housing section 92A proximate the unfiltered air chamber 95A of the air cleaner housing 89A. Therefore, the airtight holding configuration of the portion in which the throttle cables 104, 105 extend through the air cleaner housing 89A is simplified.

Further, the grommet 106 is mounted within the opening on the housing section 92A of the air cleaner housing 89A, and the throttle cables 104, 105 are inserted through the grommet 106. Therefore, the throttle cables 104, 105 can be drawn out of the air cleaner housing 89A while a seal is easily secured between the unfiltered air chamber 95A and the outside by means of the grommet 106.

Moreover, since the cover of the air cleaner housing 89A is formed from the bottom plate 82 of the fuel tank 79, the air cleaner housing 89A is formed using a less number of parts.

Further, since components including the throttle body 87 are disposed in the air cleaner housing 89A, the capacity of the air cleaner housing 89A can be sufficiently secured.

Figure 7:
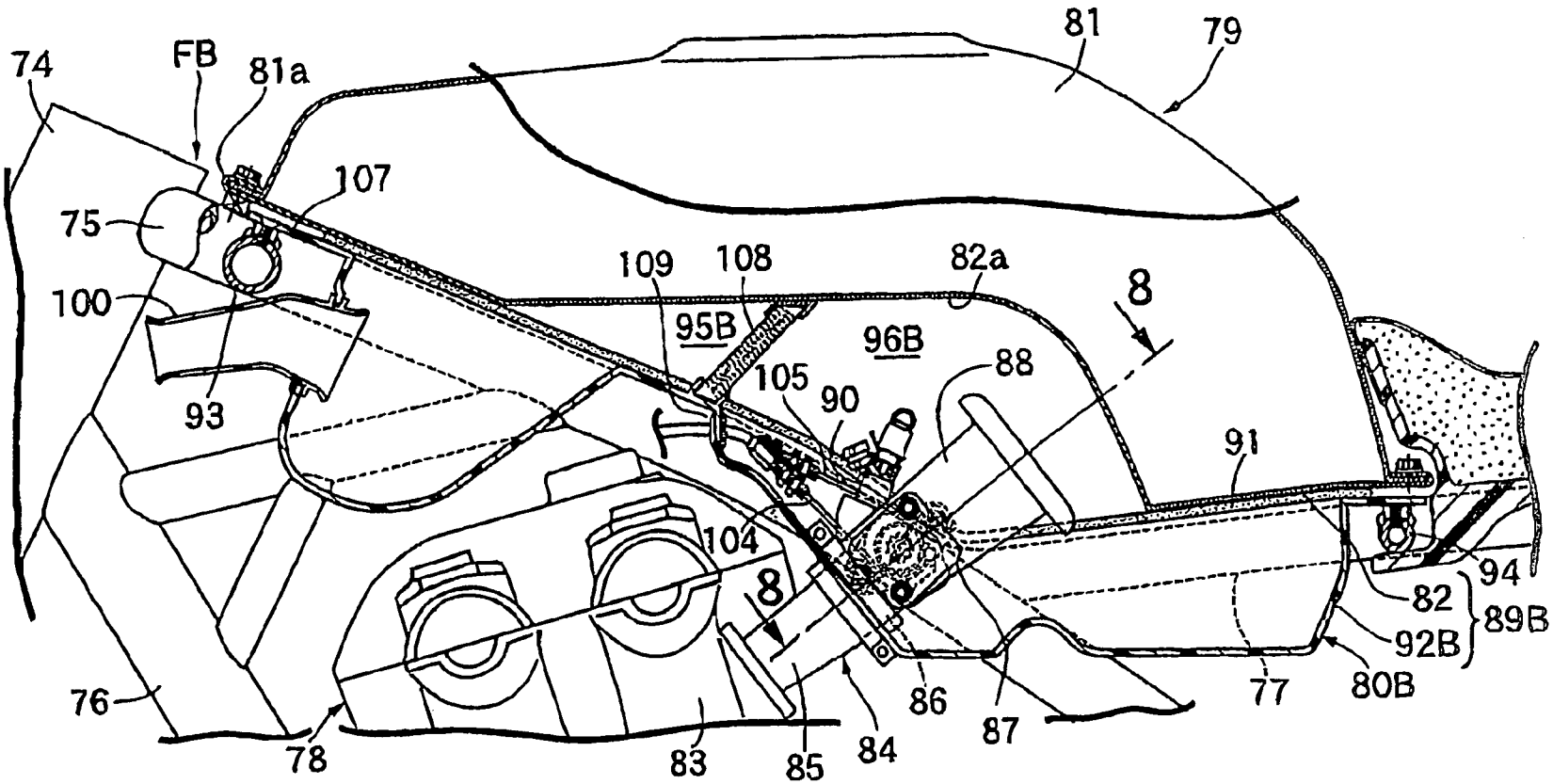
FIG. 7 is a longitudinal side view, partly in cross-section, of an air cleaner according to a fourth embodiment hereof.
Figure 8:
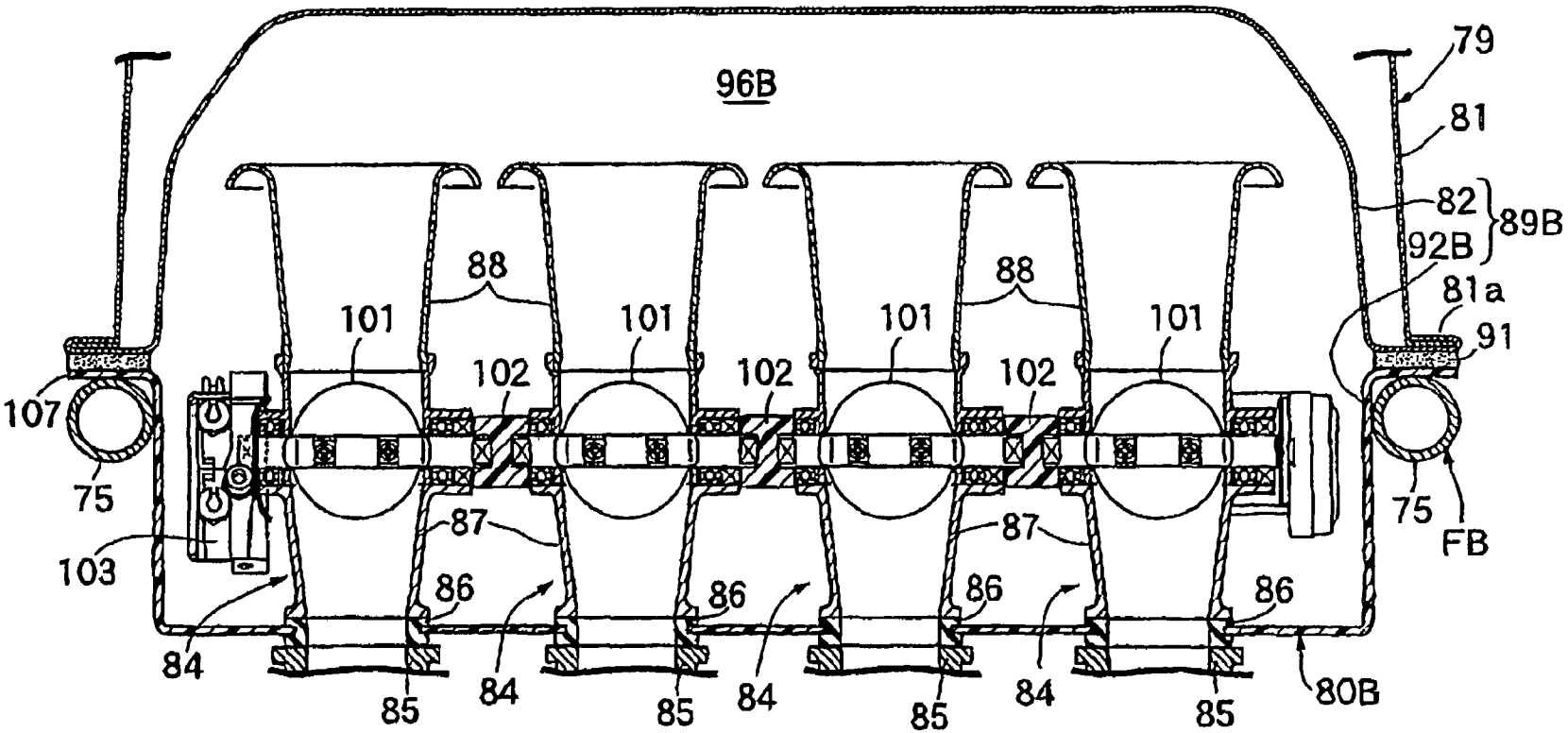
FIG. 8 is a cross-sectional view of the air cleaner of FIG. 7, taken on line 8—8 thereof.

FIG. 7 and FIG. 8 show an intake system for a motorcycle according to a fourth embodiment of the present invention. In this embodiment, the fuel tank 79 is arranged above main frames 75 and seat rails 77 provided on a body frame FB of a motorcycle. An air cleaner 80B is provided that includes an air cleaner housing 89B. Air cleaner housing 89B consists of a housing section 92B and a bottom plate 82. Housing section 92B is supported on insulators 86 of intake subassemblies 84. Bottom plate 82 is the bottom plate of a fuel tank 79 that is arranged between the engine body 78 and the fuel tank 79.

An air cleaner element 108 divides the interior of the air cleaner housing 89B into an unfiltered air chamber 95B and a filtered air chamber 96B. The air cleaner element 108 extends between the bottom plate 82 of the fuel tank 79 and the housing section 92B. Air intake funnels 88 and throttle bodies 87 are disposed in the filtered air chamber 96B.

Throttle cables 104, 105 are stretched and engaged with a throttle drum 103 arranged on the outer side of the throttle body 87 on one side in alignment with the throttle bodies 87. The cables 104, 105 are inserted through a grommet 109 mounted within an opening formed in housing section 92 B within the filtered air chamber 96B so as to extend out of the air cleaner housing 89B.

According to the fourth embodiment, the throttle bodies 87 are disposed within the air cleaner housing 89B of the air cleaner 80B, so that the operating noise of the throttle bodies 87 is substantially prevented from leaking outside the air cleaner housing 89B. Thus, the operating noise of the throttle bodies 87 is reduced or eliminated by situating the throttle bodies 87 within the air cleaner housing 89B.

Further, since the throttle bodies 87 are disposed in the filtered air chamber 96B, the throttle bodies 87 operate in a clean environment. The operating portion of the throttle bodies 87 is protected from damage from contamination by dust or the like.

Further, since components including the throttle body 87 are disposed in the air cleaner housing 89B, the capacity of the air cleaner housing 89B can be sufficiently secured.

Figure 9:
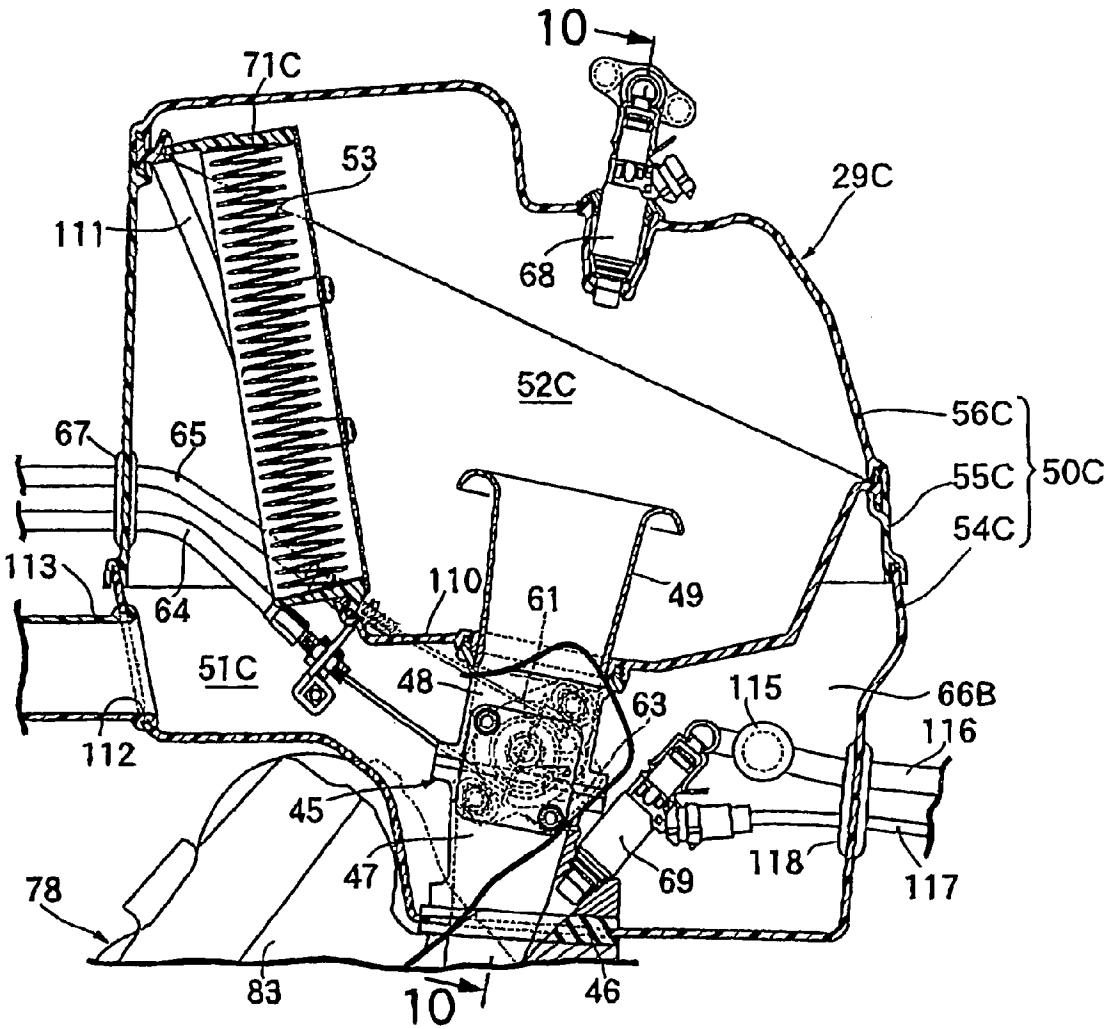
FIG. 9 is a cross-sectional detail view of an air cleaner according to a fifth embodiment hereof.
Figure 10:
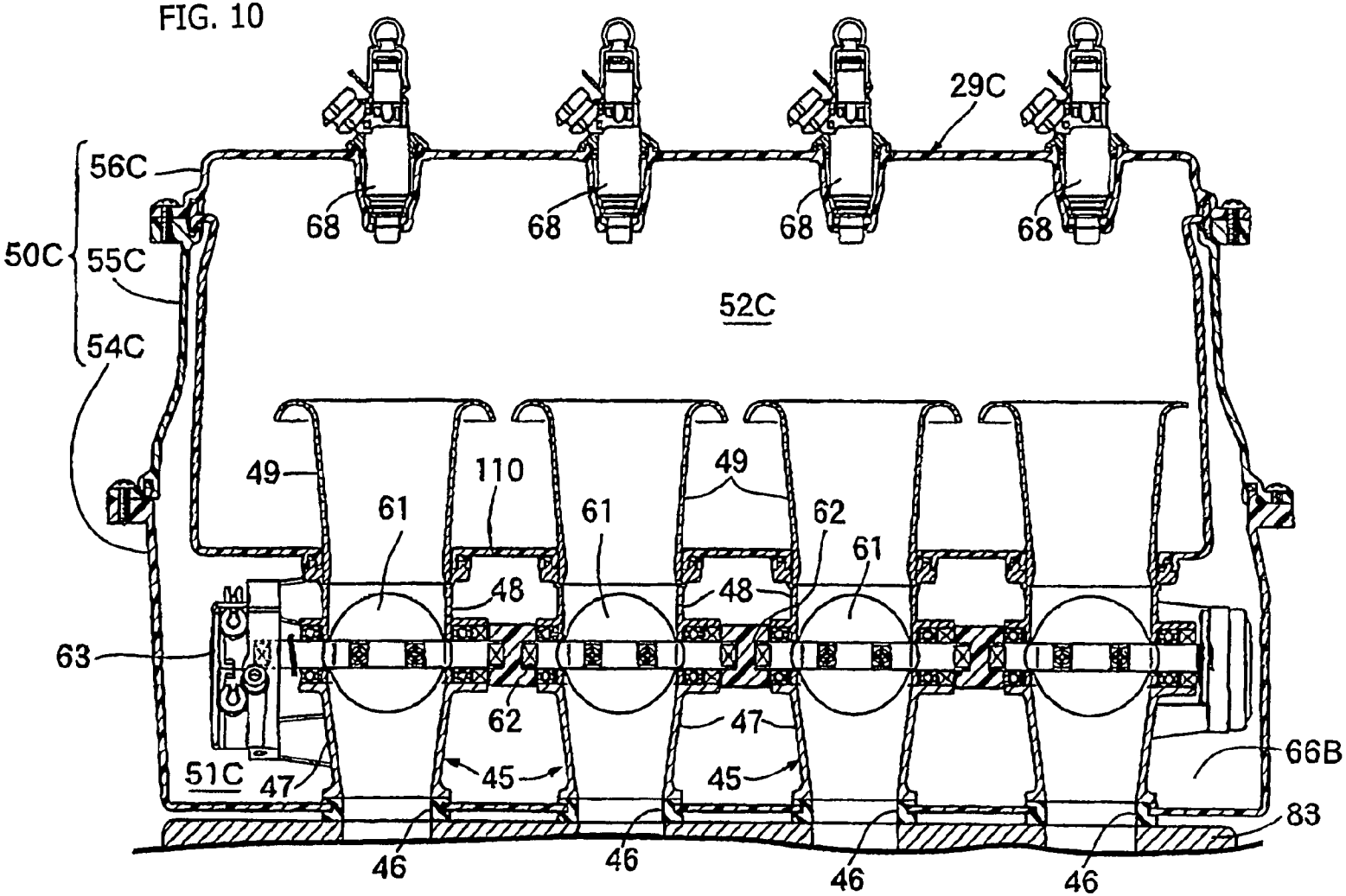
FIG. 10 is a cross-sectional view of the air cleaner of FIG. 9, taken on line 10—10 thereof.

FIG. 9 and FIG. 10 show an intake system according to a fifth embodiment of the present invention. In this embodiment, an air cleaner 29C is arranged above the engine body 78 of a series multi-cylinder engine. In this embodiment, a series four-cylinder engine air cleaner will be described, but the inventive concept is not limited to an engine having four cylinders. In the series multi-cylinder engine, a respective intake subassembly 45 for each of the cylinders extends linearly from the upper side wall of each cylinder head 83 so as to guide filtered air from the air cleaner 29C.

The intake subassembly 45 includes an insulator 46 connected to the upper side wall of the cylinder head 83, an air duct pipe 47 having the downstream end thereof connected to the insulator 46, a throttle body 48 having the downstream end thereof connected to the upstream end of the air duct pipe 47, and an air intake funnel 49 connected to the upstream end of the throttle body 48. The air duct pipe 47, the throttle body 48, and the air intake funnel 49 are disposed in an air cleaner housing 50C.

The air cleaner 29C includes an air cleaner housing 50C, and an air cleaner element 53. Air cleaner housing 50C is internally divided into the unfiltered air chamber 51C and the filtered air chamber 52C. Air cleaner element 53 filters air flowing therethrough from the unfiltered air chamber 51C to the filtered air chamber 52C. The throttle bodies 48 are disposed in the unfiltered air chamber 51C of the air cleaner housing 50C, and the air intake funnels 49 are disposed in the filtered air chamber 52C of the air cleaner housing 50C.

The air cleaner housing 50C includes a first, a second, and a third housing section 54C, 55C, and 56C, respectively. The first, second, and third housing sections 54C, 55C, and 56C are mutually connected so that the second housing section 55C lies between the first and third housing sections 54C and 56C. The first and third housing sections 54C, 56C are each formed in the shape of a bowl having mutually opposed sides and an open end. The second housing section 55C is formed in the shape of a tube, and joins the open ends of the first and third housing sections 54C, 56C.

A partition plate 110, formed of synthetic plastic, and is used to internally segment the air cleaner housing 50C into the unfiltered air chamber 51C and the filtered air chamber 52C. The whole peripheral edge of the partition plate 110 is held airtight between the connected ends of the second and third housing sections 55C, 56C.

Moreover, a support frame 71C for the air cleaner element 53 is mounted on the partition plate 110 such that it faces toward an opening 111 provided in the partition plate 110 on the front along the lateral direction of the motorcycle. Accordingly, the air cleaner element 53 can be inserted into the first and second housing sections 54C, 55C when the first and second housing sections 54C, 55C are mutually connected, but the third housing section 56C is removed. The third housing section 56C is normally connected to the second housing section 55C so as to cover the air cleaner element 53 and the partition plate 110. Thus, the air cleaner housing 50C is formed, and the air cleaner element 53 is supported on the air cleaner housing 50C.

In the fifth embodiment, the ring-like insulators 46 are interposed between the air duct pipes 47 of the intake subassemblies 45 and the cylinder head 83. The air duct pipes 47 are fastened to the cylinder heads 83 such that the ring-like insulators 46 are disposed between the air duct pipes 47 and the cylinder head 83. As a result, the first housing section 54C is supported on the insulators 46, that is, the first housing section 54C is supported on the plurality of intake subassemblies 45. Thus, the throttle bodies 48 are disposed in the unfiltered air chamber 51C so as to be held between the partition plate 110 and the air duct pipes 47. The air intake funnels 49, connected to the upper end of the throttle bodies 48, are projected into the filtered air chamber 52C above the partition plate 110.

An air-introducing hole 112 is provided to communicate with the unfiltered air chamber 51C, at the front of the first housing section 54C along the lateral direction of the motorcycle. A snorkel 113 for introducing air from the outside into the unfiltered air chamber 51C through the air-introducing hole 112 is connected to air-introducing hole 112 at both sides of the first housing section 54C.

Air introduced into the unfiltered air chamber 51C from the snorkel 113 flows from the front within the unfiltered air chamber 51C to the air cleaner element 53 side. The rear portion away from the air cleaner element 53 is to function as a suction chamber 66B, and the unfiltered air chamber 51C is formed so as to cause a part thereof to function as the suction chamber 66B.

Throttle valves 61, provided on the throttle bodies 48, are mutually connected by interlock/connection structure 62. A throttle drum 63, aligned and mutually interlocked/connected with the throttle valves 61, is arranged on the outer surface of the throttle body 48 on one end side in alignment with the direction of the throttle bodies 48.

Respective first ends of a pair of throttle cables 64, 65 for opening and closing the throttle valves 61 are mutually stretched and engaged reversibly with the throttle drum 63. The throttle cables 64, 65 are drawn outside of the air cleaner housing 50C by extending through an opening in second housing section 55C of the unfiltered air chamber 51C. Moreover, a cable grommet 67 is mounted within the opening on the second housing section 55C, and the throttle cables 64, 65 are inserted through the cable grommet 67.

Upper injectors 68 inject fuel into filtered air chamber 52C when the engine rotates at high speed. Upper injectors are mounted in the cover of the air cleaner housing 50C such that the upper injectors 68 extend downward from third housing section 56C, and such that a upper injector 68 overlies every cylinder. Air intake funnels 49, extending upward from each cylinder, are arranged within the filtered air chamber 52C corresponding to the upper injectors 68 so as to be in alignment with the upper injectors 68. Further, throttle bodies 48 are arranged so as to extend through the portion below the filtered air chamber 52C and out of the unfiltered air chamber 51C via suction chamber 47. Lower injectors 69 inject fuel at regularly timed intervals during operation of the engine, and are mounted on the air duct pipes 47 adjacent to every cylinder. The lower injectors 69 are also disposed in the unfiltered air chamber 51C of the air cleaner housing 50C.

A delivery pipe 115, aligned with and in common to the lower injectors 69 is disposed in the unfiltered air chamber 51C. A fuel pipe 116, connected to the delivery pipe 115, and conductors 117, connected to the lower injectors 69, are each drawn outside air cleaner housing 50C such that they extend through a harness grommet 118 mounted on the first housing section 54C of the air cleaner housing 50C.

According to the fifth embodiment, since the throttle bodies 48 are disposed in the air cleaner housing 50C of the air cleaner 29C, the operating noise of the throttle bodies 48 is substantially prevented from leaking outside the air cleaner housing 50C. Thus, the operating noise of the throttle bodies 48 can reduced or eliminated by situating the throttle bodies 48 in the air cleaner housing 50C. Further, by situating the throttle bodies 48 inside the air cleaner housing 50C, it is possible to prevent rainwater or the like from dropping on the throttle bodies 48.

Further, the unfiltered air chamber 5C is formed so as to cause a part thereof to function as a suction chamber 66C. Since suction chamber 66C is formed within unfiltered air chamber 51C, using exclusive-use parts to form the suction chamber 66C is rendered unnecessary, and the number of parts can be reduced to reduce the costs. Since the lower injectors 69 are also disposed in the unfiltered air chamber 51C, the lower injectors 69 are covered and protected by the air cleaner housing 50C, and the operating noise of the lower injectors 69 is substantially prevented from leaking outside the air cleaner housing 50C. Thus, the operating noise of the lower injectors 69 is reduced or eliminated.

Further, the throttle bodies 48 are disposed in the unfiltered air chamber 51C, and the throttle cables 64, 65 for opening and closing the throttle valves 61 of the throttle bodies 48 are drawn outside air cleaner 29C by extending through an opening in the wall of the housing 50C adjacent the unfiltered air chamber 5C thereof. Therefore, it is possible to simplify the airtight holding configuration of the portion of the throttle cables 64, 65 that extend through the air cleaner housing 50C.

Moreover, the air cleaner housing 50C includes the first, second, and third housing sections 54C, 55C, and 56C, respectively. The first, second, and third housing sections 54C, 55C, and 56C are mutually connected such that the second housing section 55C is positioned between the first and third housing sections 54C, 56C. The first housing section 54C is supported on the intake subassembly 45. The air cleaner element 53 can be inserted into the first and second housing sections 54C, 55C when the first and second housing sections 54C, 55C are mutually connected but the third housing section 56C is removed. The air cleaner element 53 is supported on the air cleaner housing 50C according to coupling of the third housing section 56C overlying the air cleaner element 53 to the second housing section 55C. Thus, despite a configuration in which components, including the throttle body 48, are disposed in the air cleaner housing 50C, assembly of the air cleaner 50C can be carried out easily.

Further, the cable grommet 67 is mounted on the second housing section 55C of the air cleaner housing 50C, and the throttle cables 64, 65 are inserted through the cable grommet 67. Therefore, it is possible to draw the throttle cables 64, 65 out of the air cleaner housing 50C while easily securing the sealability between the unfiltered air chamber 51C and the outside. Further, the harness grommet 118 is mounted on the first housing section 54C of the air cleaner housing 50C, and portions of the conductors 117 and the fuel pipe 116 extend through the harness grommet 118. Therefore, the fuel pipe 116 and the conductors 117 can be drawn out of the air cleaner housing 50C while easily securing the sealability between the unfiltered air chamber 51C and the outside.

Further, since components, including the throttle body 48, are disposed in the air cleaner housing 50C, the capacity of the air cleaner housing 50C can be sufficiently secured.

Figure 11:
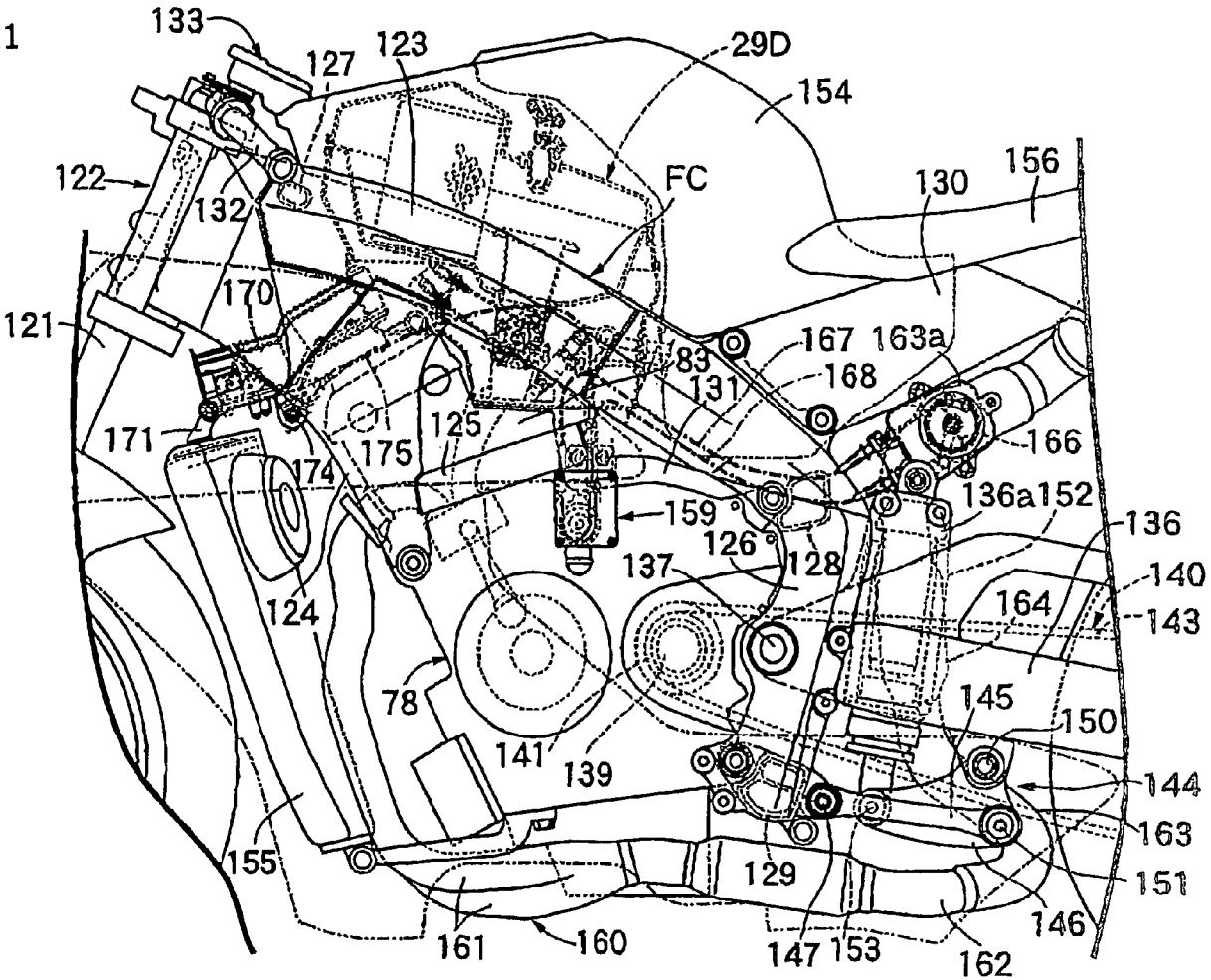
FIG. 11 is a side view of selected parts of a motorcycle according to a sixth embodiment hereof.
Figure 12:
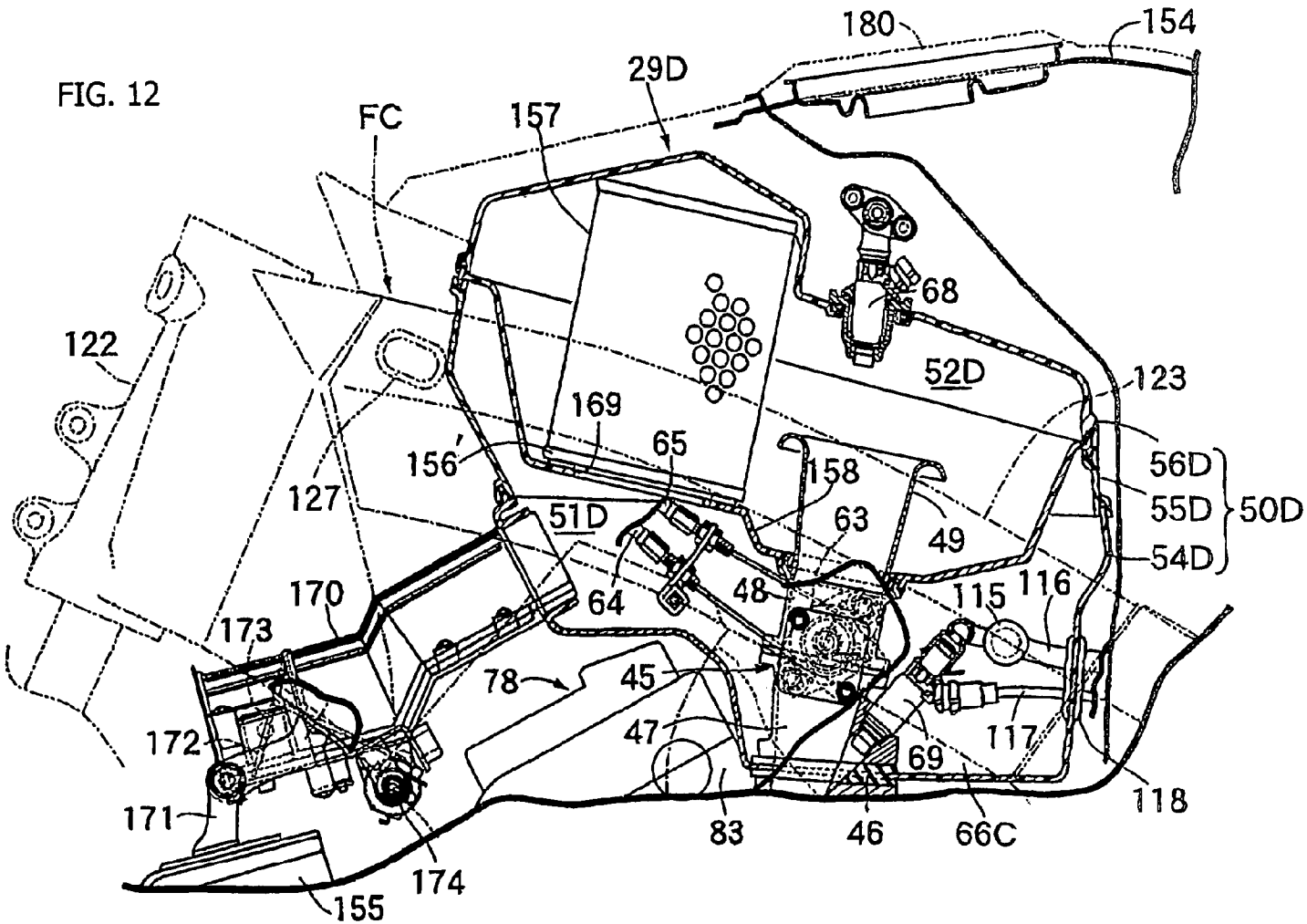
FIG. 12 is a cross-sectional detail view of a sixth embodiment of an air cleaner.

FIG. 11 and FIG. 12 show a sixth embodiment of the present invention. As seen in FIG. 11, a body frame FC of the motorcycle includes a head pipe 122, a pair of left and right main frames 123, a pair of left and right engine hangers 124, connection pipes 125, a pair of left and right pivot plates 126, a first cross pipe 127, a second cross pipe 128, a third cross pipe 129, and a pair of left and right seat rails 130. The head pipe 122 supports a front fork 121 in a manner capable of steering. The pair of left and right main frames 123 extend backward and downward from the head pipe 122. The pair of left and right engine hangers 124 are welded to the front of the head pipe 122 and both the main frames 123 and extend downward from the main frames 123. The connection pipes 125 connect support plates 131 provided at the lower part of both the engine hangers 124 and at the rear of the main frames 123. The pair of left and right pivot plates 126 extend downward from the rear portion of the main frames 123. The first cross pipe 127 is mounted between the front portions of the main frames 123. The second cross pipe 128 is mounted between the upper portions of both the pivot plates 126. The third cross pipe 129 is mounted between the lower portions of both the pivot plates 126. The pair of left and right seat rails 130 extend backward and upward and are connected to the rear portions of both the main frames 123.

Left and right individual bar-like steering handles 132 are connected to the upper portion of the front fork 121. A steering damper 133 is provided between the front end of the body frame FC, that is, the head pipe 122, and the front fork 121.

The engine body 78 of a multi-cylinder engine is supported the lower portion of both the engine hangers 124, and at the upper portion and lower portion of both the pivot plates 126. An engine having four cylinders arranged in parallel widthwise of the body frame FC is described herein, but the inventive concept is not limited to an engine having four cylinders.

The front end of a swing arm 136 is supported, in a swinging manner, through a support shaft 137 in a vertical intermediate portion of both the pivot plates 126, and the axle of a rear wheel is rotatably supported on the rear end of the swing arm 136.

Power from an output shaft 139 disposed in the engine body 78 is transmitted to the rear wheel WR through chain transmission mechanism 140. The chain transmission mechanism 140 includes a driving sprocket 141 secured to the output shaft 139, a driven sprocket (not shown) secured to the rear wheel, and an endless chain 143 stretched over the driving sprocket 141 and the driven sprocket. The chain transmission mechanism 140 is arranged on the left side of the engine in the state directed forward in the moving direction of the motorcycle.

A link mechanism 144 is provided between a third cross pipe 129 connecting between the lower portions of both the pivot plates 126 and the swing arm 136. The link mechanism 144 includes a first link 145 and a second link 146. The first link 145 has one end connected to the third cross pipe 129 rotatably about an axis of a first connection shaft 147 in parallel with the support shaft 137. The second link 146 is connected to the lower portion of the swing arm 136 rotatably about an axis of a second connection shaft 150 in parallel with the first connection shaft 147 and connected to the other end of the first link 145 through a third connection shaft 151 in parallel with the first and second connection shafts 147, 150.

The other end of the first link 145 is connected through the third connection shaft 151 to the rear portion of the second link 146. The lower end of a rear shock absorber 152 having the upper end connected to a bracket 136a provided in front of the swing arm 136 is connected through a fourth connection shaft 153 to the front portion of the second link 146.

An air cleaner 29D for supplying filtered air to the engine is arranged, above the cylinder head 83 in the engine body 78, so as to be positioned at the rear of the head pipe 122 in the body frame FC. A fuel tank 154 covering the rear portion and upper portion of the air cleaner 29D is mounted on both the main frames 123 in the body frame FC, and a radiator 155 is arranged forward of the engine body 78. A seat 156 on which a rider may be seated is supported on seat rails 130 at the rear of the fuel tank 154.

An exhaust system 160 communicates with the cylinder head 83 of the engine body 78. The exhaust system 160 includes individual exhaust pipes 161, 161, a pair of first manifolds 162, a single second manifold 163, and a second exhaust muffler (not shown). The exhaust pipes 161, 161 are individually connected to the lower portion of the side wall on the forward side of the cylinder head 83. The pair of first manifolds 162 have a pair of exhaust pipes 161, 161 connected in common. The single second manifold 163 has a pair of first manifolds 162 connected in common and has a first exhaust muffler 164 interposed in the intermediate portion. The second exhaust muffler is connected to the downstream end of the second manifold 163.

The individual exhaust pipes 161, 161 extend from the front of the engine body 78, and the first manifolds 162 are arranged so as to extend approximately in the lateral direction downward of the engine body 78. Further, the second manifold 163 rises while being curved so as to direct at the right side of the body from the lower part of the engine body and is further extended backward. Thus, the first exhaust muffler 164 is interposed at the rising portion of the second manifold 163.

An enlarged diameter portion 163*a* is provided at the intermediate portion of the second manifold 163. An exhaust control valve 166 is disposed within the enlarged diameter portion 163*a*. The valve 166 changes a communication area internally of the second manifold 163 according to the rotational frequency of the engine to control exhaust pulsation in the exhaust system 160.

An actuator 159 is supported on one support plate 131 in the body frame FC. The portion between the exhaust control valve 166 and the actuator 159 is connected by a pair of transmission wires 167, 168. One of both the transmission wires 167, 168 is drawn according to the operation of the actuator 159 whereby the exhaust control valve 166 is driven to be opened and closed.

In FIG. 12, an intake subassembly 45 is operatively connected to each of the respective cylinders at the upper side wall of the cylinder head 83, and these intake subassemblies are each extending linearly so as to guide filtered air from the air cleaner 29D. The throttle body 48, provided on each intake subassembly 45, is connected to the upper side wall of the cylinder head 83 via the air duct pipe 47 and the insulator 46.

The air cleaner 29D includes air cleaner housing 50D, and a cylindrical air cleaner element 157 within air cleaner housing 50D. The air cleaner housing 50D is internally divided into the unfiltered air chamber 51D and the filtered air chamber 52D. The air cleaner element 157 filters air flowing from the unfiltered air chamber 51D to the filtered air chamber 52D. The air cleaner element 157 is fixedly disposed, so as to be positioned above the unfiltered air chamber 51D, within an air cleaner housing 50D. The throttle bodies 48 are disposed in the unfiltered air chamber 51D of the air cleaner housing 50D, and the air intake funnels 49 are disposed in the filtered air chamber 52D of the air cleaner housing 50D.

The air cleaner housing 50D includes a first, a second, and a third housing section 54D, 55D, and 56D, each formed of synthetic plastic, that are mutually connected so as to sandwich the second housing section 55D between the first and third housing sections 54D and 56D. The first and third housing sections 54D, 56D are each formed to be in the shape of a bowl having mutually opposed sides and an open end. The second housing section 55D is formed having a tubular shape and joins the respective open ends of the first and third housing sections 54D, 56D.

The partition plate 158, formed of synthetic plastic, includes a peripheral edge. The whole peripheral edge is held airtight between the connected ends of the second and third housing sections 55D, 56D. The air cleaner housing 50D is internally divided into the unfiltered air chamber 51D and the filtered air chamber 52D by the partition plate 158.

Moreover, a support frame 156' of the air cleaner element 157 is mounted on the partition plate 158 facing toward an opening 169 provided in the partition plate 158 in the front along the lateral direction of the motorcycle. Accordingly, when the first and second housing sections 54D, 55D are mutually connected but the third housing section 56D is removed, the air cleaner element 157 having the support frame 156' mounted on the partition plate 158 may be inserted into the first and second housing sections 54D, 55D. In use, the third housing section 56D is connected to the second housing section 55D so as to cover the air cleaner element 157 and the partition plate 158. Thus, the air cleaner housing 50D is so formed and the air cleaner element 157 is supported within the air cleaner housing 50D.

The first housing section 54D is supported on the plural intake subassemblies 45. Intake subassemblies 45 include the air duct pipes 47. Air duct pipes 47 are fastened to the cylinder head 83 such that the insulators 46 of the intake subassemblies 45 are sandwiched between the air duct pipes 47 and the cylinder head 83. Additionally, the first housing section 54D is supported on the insulators 46, therefore the first housing section 54D is supported on the plurality of intake subassemblies 45. As a result, the throttle bodies 48 are disposed in the unfiltered air chamber 51D so as to be sandwiched between the partition plate 158 and the air duct pipes 47. The air intake funnels 49, connected to the upper ends of the throttle bodies 48, are projected into the filtered air chamber 52D from the partitioning late 158.

A snorkel 170 for introducing outside air into the air cleaner 29D is arranged so as to extend forward from the air cleaner 29D, below head pipe 121 provided on the front end of the body frame FC. The rear end of the snorkel 170 is connected to the front portion of the first housing section 54D in the air cleaner housing 50D so as to introduce outside air into the front portion of the unfiltered air chamber 51D.

Air introduced into the unfiltered air chamber 51D from the snorkel 170 flows from the front portion within the unfiltered air chamber 51D toward the air cleaner element 157 as described. The portion away from the air cleaner element 157, that is, the rear portion within the unfiltered air chamber 51D functions as a suction chamber 66C. Thus, the unfiltered air chamber 51D is formed so as to cause a part thereof to function as the suction chamber 66C.

The snorkel 170 is formed so that the rear portion is inclined backward and upward as viewed from the side, and the front portion of the snorkel 170 is supported on the body frame FC (see FIG. 12). The radiator 155 is arranged downward of the snorkel 170. Stays 171 are extended upward from both sides of the radiator 155, and the front portion of the snorkel 170 is supported by the stays 171.

A pair of suction control valves 172, 173 for controlling a suction communication area within the snorkel 170 according to the rotational frequency of the engine are disposed within the front portion of the snorkel 170. The suction control valves 172, 173 are interlock-operated according to rotation of a rotating shaft 174. The rotating force is transmitted to the rotating shaft 174 through a transmission wire 175 (see FIG. 11) from the actuator 159.

The first ends of a pair of throttle cables 64, 65, for opening and closing the throttle valves 61 that are provided on the throttle bodies 48, are mutually stretched and engaged reversibly with the throttle valves 61 via a throttle drum. The throttle cables 64, 65 are drawn outside air cleaner 29D by extending through an opening in the second housing section 55D within the unfiltered air chamber 51D and out of the air cleaner housing 50D. Moreover, a cable grommet 67 is mounted within the opening on the second housing section 55D, and the throttle cables 64, 65 are inserted through the cable grommet 67.

The upper injectors 68 inject fuel into filtered air chamber 52D when the engine rotates at high speed. The upper injectors 68 are mounted in the cover of the air cleaner housing 50D on the third housing section 56D so as to overlie the filtered air chamber 52D and each cylinder. The air intake funnels 49 corresponding to the cylinders are arranged within the filtered air chamber 52D in alignment with the upper injectors 68. Further, the throttle bodies 48 are connected to the lower end of air intake funnels 49, and the air duct pipes 47 are connected to a lower end of throttle body 48 and join the throttle bodies 48 and the cylinder head 83. Thus, throttle bodies 48 and air duct pipes 47 extend through and subsequently out of the unfiltered air chamber 51D. Further, the throttle bodies 48 are disposed within the unfiltered air chamber 51D of the air cleaner housing 50D.

The lower injectors 69 always injecting fuel during operation of the engine, and are mounted on the air duct pipes 47 of each cylinder. The lower injectors 69 are also disposed in the unfiltered air chamber 51D of the air cleaner housing 50D.

A delivery pipe 115 communicating with and in common to the lower injectors 69 is disposed in the unfiltered air chamber 51D. A fuel pipe 116, connected to the delivery pipe 115, and conductors 117, connected to the lower injectors 69, both extend through an opening in first housing section 54D to the outside of air cleaner housing 50D. The harness grommet 118 is mounted within the opening in the first housing section 54D of the air cleaner housing 50D within the unfiltered air chamber 51D, and fuel pipe 116 and conductors 117 are inserted through the harness grommet 118.

The sixth embodiment also provides the effects similar to the fifth embodiment.

Figure 13:
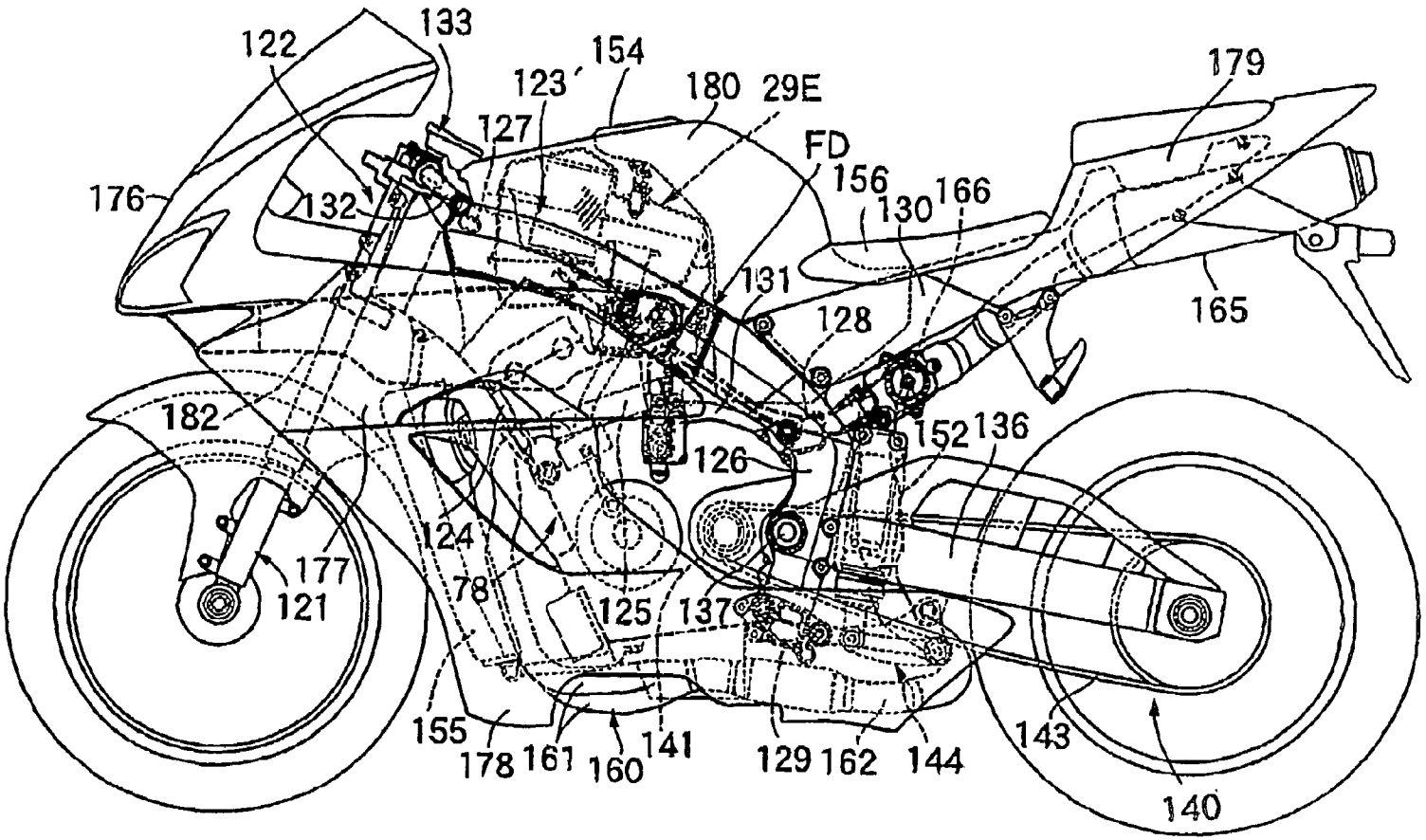
FIG. 13 is a side elevational view of a motorcycle including an intake system according to a seventh embodiment hereof.
Figure 14:
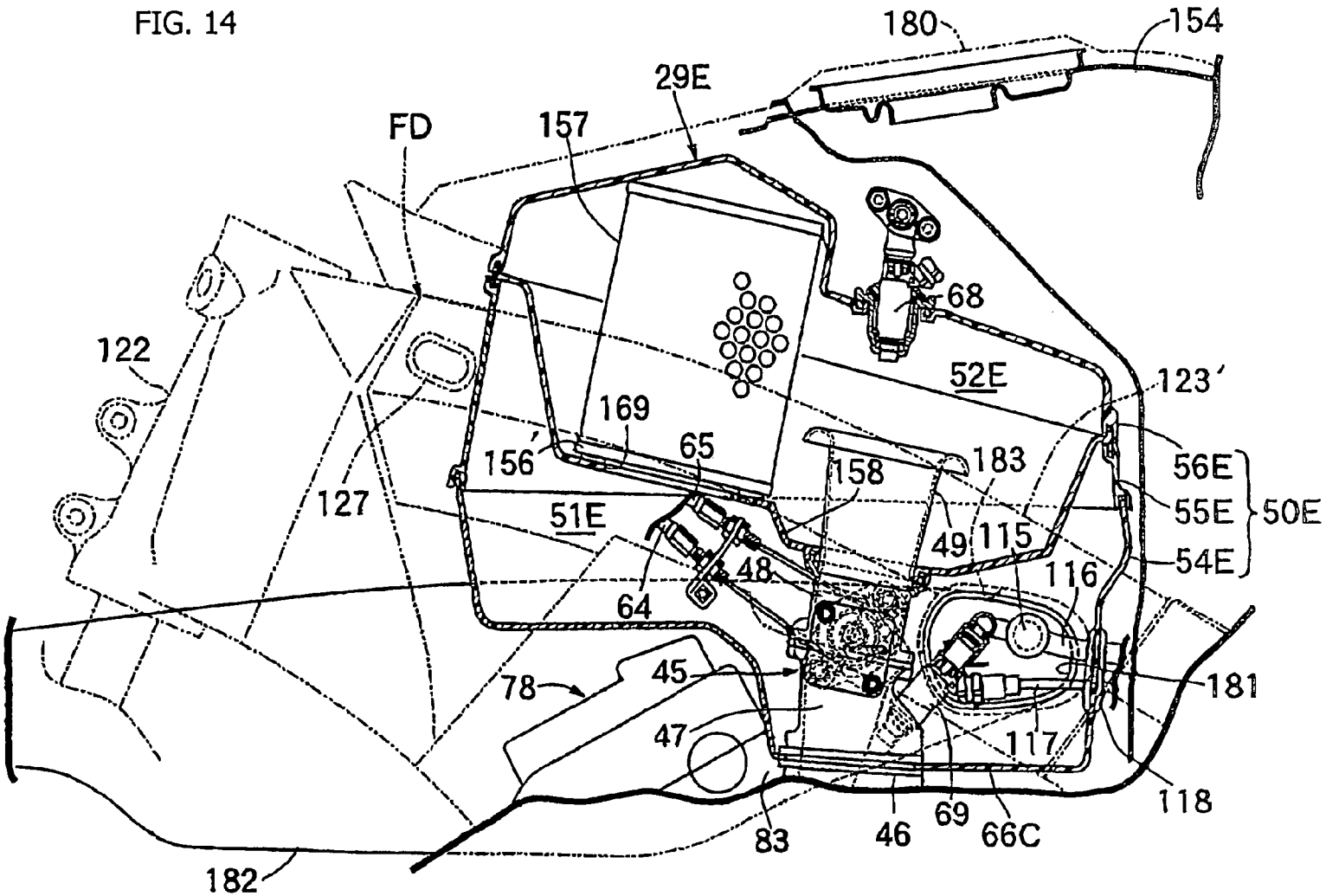
FIG. 14 is a cross-sectional detail view of a seventh embodiment of an air cleaner, which is mounted on the motorcycle of FIG. 13.

FIG. 13 and FIG. 14 show a seventh embodiment of the present invention. As seen in FIG. 13, a body frame FD of the motorcycle includes a head pipe 122, a pair of left and right main frames 123', a pair of left and right engine hangers 124, connection pipes 125, a pair of left and right pivot plates 126, a first cross pipe 127, a second cross pipe 128, a third cross pipe 129, and a pair of left and right seat rails 130. The head pipe 122 supports a front fork 121 in a manner capable of steering. The pair of left and right main frames 123' extend backward and downward from the head pipe 122. The pair of left and right engine hangers 124 are welded to the front of the head pipe 122 and the front portions of both the main frames 123' and are extended downward from the main frames 123'. The connection pipes 125 connect support plates 131 provided at the lower part of both the engine hangers 124 and at the rear of the main frames 123'. The pair of left and right pivot plates 126 extend downward from the rear portion of the main frames 123'. The first cross pipe 127 is mounted between the front portions of the main frames 123'. The second cross pipe 128 is mounted between the upper portions of both the pivot plates 126. The third cross pipe 129 is mounted between the lower portions of both the pivot plates 126. The pair of left and right seat rails 130 extend backward and upward and connected to the rear portions of both the main frames 123'.

An air cleaner 29E for supplying filtered air to the engine is arranged so as to be positioned at the rear of the head pipe 122 in the body frame FD, above a cylinder head 83 in the engine body 78 of a multi-cylinder engine. The engine body 78 is supported on the lower portion of both the engine hangers 124 and the upper and lower portions of both the pivot plates 126. A fuel tank 154 covering the rear portion and the upper portion of the air cleaner 29E is mounted on both the main frames 123' in the body frame FD.

In FIG. 14, an intake subassembly 45 extends linearly above each cylinder head 83 for each of the respective cylinders, so as to guide filtered air from the air cleaner 29E. An intake subassembly 45 is connected to each respective cylinder at the upper side wall of the cylinder head 83. The throttle body 48, provided on the intake subassemblies 45, is connected to the upper side wall of the cylinder head 83 through the air duct pipe 47 and the insulator 46.

The air cleaner 29E consists of an air cleaner housing 50E and a cylindrical air cleaner element 157. The air cleaner housing 50E is internally divided into the unfiltered air chamber 51E and the filtered air chamber 52E. The air cleaner element 157 filters air flowing from the unfiltered air chamber 51E to the filtered air chamber 52E, and is fixedly disposed so as to be positioned above the unfiltered air chamber 51E, in an air cleaner housing 50E. The throttle bodies 48 are disposed in the unfiltered air chamber 51E of the air cleaner housing 50E, and the air intake funnels 49 are disposed in the filtered air chamber 52E of the air cleaner housing 50E.

The air cleaner housing 50E includes a first, a second, and a third housing sections 54E, 55E, and 56E, respectively. First, second, and third housing sections 54E, 55E, and 56E are formed of synthetic plastic and are mutually connected so as to sandwich the second housing section 55E between the first and third housing sections 54E and 56E. The first and third housing sections 54E, 56E are each formed in the shape of a bowl having mutually opposed sides and an open end. The second housing section 55E is formed having a tubular shape and joins the respective open ends of the first and third housing sections 54E, 56E.

The whole peripheral edge of a partition plate 158, formed of synthetic plastic, is held airtight between the connected ends of the second and third housing sections 55E, 56E. The air cleaner housing 50E is internally divided into the unfiltered air chamber 51E and the filtered air chamber 52E by the partition plate 158.

Moreover, the support frame 156' of the air cleaner element 157 is mounted on the partition plate 158 such that it faces toward an opening 169. Opening 169 is provided in the partition plate 158 adjacent the front of air cleaner housing 50E along the lateral direction of the motorcycle. Accordingly, when the first and second housing sections 54E, 55E are mutually connected but the third housing section 56E is removed, the air cleaner element 157, including the support frame 156' mounted on the partition plate 158, can be inserted into the first and second housing sections 54E, 55E. In use, the third housing section 56E is detachably connected to the second housing section 55E so as to cover the air cleaner element 157 and the partition plate 158. Thus, the air cleaner housing 50E is so formed and the air cleaner element 157 is supported on the air cleaner housing 50E.

The throttle bodies 48 are disposed in the unfiltered air chamber 51E so as to be sandwiched between the partition plate 158 and the air duct pipes 47. The air intake funnels 49, connected to the throttle bodies 48, are projected into the filtered air chamber 52E from the partition plate 158.

In addition, the front portion of the head pipe 122 is covered with a front cowl 176. Both front sides of the body are covered with a pair of left and right center cowls 177 that are aligned with the front cowl 176. Lower cowls 178, covering major portions of the individual exhaust pipes 161 constituting a part of the engine body 78 and a part of the exhaust system 160, are aligned with the center cowls 177. Further, the major portions of the second exhaust muffler 165 provided on the downstream end of the exhaust system 160 and the rear portions of both the seat rails 130 are covered with the rear cowl 179, and the fuel tank 154 and the air cleaner 29E are covered with a cover 180.

Suction holes 181 for introducing outside air into the rear portion of the unfiltered air chamber 51E are provided both sides at the rear of the first housing section 54E in the air cleaner housing 50E. Snorkels 182 for communicating with the downstream end with the suction holes 181 are provided. Snorkels 182 extend through insert holes 183 provided in the intermediate portions of both the main frames 123' to extend the portion between the center cowls 177 and both the main frames 123' forward.

Air introduced into the rear portion of air cleaner housing 50E within the unfiltered air chamber 51E from the snorkels 182 flows from the front portion within the unfiltered air chamber 51E toward the air cleaner element 157. A portion of the unfiltered air chamber 51E functions as a suction chamber.

The seventh embodiment also provides the effects similar to the fifth embodiment.

Although the present invention has been described herein with respect to a number of specific illustrative embodiments, the foregoing description is intended to be illustrative, and not restrictive. Those skilled in the art will realize that many modifications of the embodiments could be made which would be operable. All such modifications which are within the scope of the claims are intended to be within the scope and spirit of the present invention.

Having thus, described the invention, what is claimed is:

1. An intake system for a vehicle engine, said intake system comprising an air cleaner and a plurality of throttle bodies, wherein the air cleaner comprises an air cleaner housing and an air cleaner element disposed in the air cleaner housing, the air cleaner housing having an interior that is divided into an unfiltered air chamber and a filtered air chamber, wherein the air cleaner element is positioned within the air cleaner housing so as to filter air flowing therethrough from the unfiltered air chamber to the filtered air chamber, and wherein the throttle bodies control the amount of air supplied from said filtered air chamber to a cylinder head;

wherein each of the throttle bodies comprises a substantially cylindrical pipe having a hollow bore formed therein, and a throttle valve including a throttle plate which is pivotally mounted inside the hollow bore of the throttle body;

and wherein said throttle valves of said throttle bodies are situated inside of said air cleaner housing.

2. The intake system for a vehicle engine according to claim 1, wherein said unfiltered air chamber is formed such that a portion of the unfiltered air chamber functions as a suction chamber.

3. The intake system for a vehicle engine according to claim 1, wherein said throttle bodies are disposed in said unfiltered air chamber.

4. The intake system for a vehicle engine according to claim 3, wherein the throttle bodies have throttle cables extending therefrom, and wherein the throttle cables extending from said throttle bodies extend outside the air cleaner housing by passing through a first opening in said air cleaner housing proximate the unfiltered air chamber thereof.

5. The intake system for a vehicle engine according to claim 4, further comprising a cable grommet mounted within said first opening in the air cleaner housing proximate the unfiltered air chamber, and wherein said throttle cables are inserted through said cable grommet.

6. The intake system for a vehicle engine according to claim 5, further comprising a harness grommet, and a plurality of fuel injectors disposed in said unfiltered air chamber, wherein a fuel pipe for supplying fuel to said injectors, and conductors connected to said injectors are each drawn outside the air cleaner housing by passing through a second opening in said air cleaner housing proximate the unfiltered air chamber thereof, and wherein said harness grommet is mounted within said second opening in said air cleaner, and said fuel pipe and conductors are inserted through said harness grommet.

7. An intake system for a vehicle engine, said intake system comprising an air cleaner and a plurality of throttle bodies, wherein the air cleaner comprises an air cleaner housing and an air cleaner element disposed in the air cleaner housing, the air cleaner housing having an interior that is divided into an unfiltered air chamber and a filtered air chamber, wherein the air cleaner element is positioned within the air cleaner housing so as to filter air flowing therethrough from the unfiltered air chamber to the filtered air chamber;

wherein the throttle bodies control the amount of air supplied from said filtered air chamber to a cylinder head; and wherein said throttle bodies are at least partially situated in said air cleaner housing;

wherein said air cleaner housing includes a first, a second, and a third housing section, wherein each throttle body forms part of an intake subassembly, wherein each intake subassembly is connected to a cylinder head, wherein the first, the second, and the third housing sections are connected such that said second housing section is positioned between said first and third housing sections;

wherein said first housing section is supported on the intake subassemblies;

wherein said air cleaner element can be inserted into said first and second housing sections when said first and second housing sections are mutually connected but when said third housing section is removed, and wherein said air cleaner element is supported in the air cleaner housing between the third housing section and the second housing section.

8. The intake system for a vehicle engine according to claim 1, wherein a cover portion of said air cleaner housing is formed by a bottom plate of a fuel tank.

9. The intake system for a vehicle engine according to claim 1, wherein said air cleaner clement is arranged at a top portion of said unfiltered air chamber.

10. The intake system for a vehicle engine according to claim 2, wherein said throttle bodies are disposed in said unfiltered air chamber.

11. An air intake system for an engine of a vehicle, said intake system comprising an air cleaner and at least one intake subassembly comprising a throttle body, an air duct pipe, and an air intake funnel, wherein said at least one intake subassembly is adapted to be mounted to a cylinder head of an engine, the air cleaner comprises an air cleaner housing and an air cleaner element, the air cleaner housing divided into an unfiltered air chamber and a filtered air chamber, the air cleaner element supported within the air cleaner housing such that air is filtered as it flows therethrough from the unfiltered air chamber into the filtered air chamber;

wherein the throttle body and the air intake funnel are entirely disposed inside of the air cleaner housing.

12. The air intake system of claim 11, further comprising a fuel injector operatively attached to said throttle body, said fuel injector also being disposed within the air cleaner housing.

13. The air intake system of claim 12, wherein the throttle body is disposed within the unfiltered air chamber.

14. The air intake system of claim 13, wherein the unfiltered air chamber is formed and configured such that a portion thereof functions as a suction chamber.

15. The air intake system of claim 11, wherein the throttle body is disposed within the filtered air chamber.

16. The air intake system of claim 12, wherein the air cleaner housing comprises a first housing section, a second housing section, and a third housing section, wherein the second housing section is substantially tubular in shape, and the third housing section has mutually opposing sides, a closed lower end, and an open upper end, the second housing section being fixed to the open upper end of the third housing section, the second housing section being detachably secured to the first housing section to allow insertion of the air cleaner element into the air cleaner housing;

and wherein when in use, the first housing section is secured to the second housing section such that it covers the air cleaner element and the air cleaner element is housed within the air cleaner housing.

17. The air intake system of claim 16, wherein a partition is used to divide the filtered air chamber from the unfiltered air chamber, and wherein the partition is supported in the air cleaner housing at a position above the throttle body.

18. The air intake system of claim 16, further comprising a first fuel injector mounted on the throttle body for injecting fuel thereinto, and wherein said first fuel injector is disposed within the unfiltered air chamber of the air cleaner housing.

19. The air intake system of claim 16, further comprising a first fuel injector mounted on the throttle body for injecting fuel thereinto, and wherein said first fuel injector is disposed within the filtered air chamber within the air cleaner housing.

20. The air intake system of claim 11, wherein the first housing section is firmed by the underside of a fuel tank.

21. An intake system for a vehicle engine, said intake system comprising an air cleaner, a plurality of throttle bodies, and a plurality of fuel injectors, wherein the air cleaner comprises an air cleaner housing and an air cleaner element disposed in the air cleaner housing, the air cleaner housing having an interior that is divided into an unfiltered air chamber and a filtered air chamber, wherein the air cleaner element is positioned within the air cleaner housing so as to filter air flowing therethrough from the unfiltered air chamber to the filtered air chamber, and wherein the throttle bodies control the amount of air supplied from said filtered air chamber to a cylinder head;

wherein said throttle bodies are at least partially situated in said air cleaner housing;

and wherein each of said throttle bodies has one of said fuel injectors operatively attached thereto inside of said air cleaner housing.

* * * * *